US012742372B2

(12) United States Patent
Dumanli

(10) Patent No.: US 12,742,372 B2
(45) Date of Patent: Sep. 22, 2026

(54) ELECTRONIC DEVICE AND METHOD FOR ORIENTATION-MEASURING DEVICE FOR DOWNHOLE PERFORATIONS

(71) Applicant: Advanced Wireline Solutions, Inc., Houston, TX (US)

(72) Inventor: Hasan Dumanli, Houston, TX (US)

(73) Assignee: Advanced Wireline Solutions, Inc., Houston, TX (US)

( * ) Notice: Subject to any disclaimer, the term of this patent is extended or adjusted under 35 U.S.C. 154(b) by 0 days.

(21) Appl. No.: 18/747,918

(22) Filed: Jun. 19, 2024

(65) Prior Publication Data

US 2024/0426196 A1 Dec. 26, 2024

Related U.S. Application Data

(60) Provisional application No. 63/510,022, filed on Jun. 23, 2023.

(51) Int. Cl.
*E21B 43/119* (2006.01)
*E21B 43/117* (2006.01)
*E21B 43/1185* (2006.01)

(52) U.S. Cl.
CPC ..... *E21B 43/119* (2013.01); *E21B 43/117* (2013.01); *E21B 43/11857* (2013.01)

(58) Field of Classification Search
CPC . E21B 43/119; E21B 43/118; E21B 43/11857
See application file for complete search history.

(56) References Cited

U.S. PATENT DOCUMENTS 4,611,660 A * 9/1986 Stout ..... E21B 43/11855 166/55
5,964,294 A 10/1999 Edwards
6,604,584 B2 8/2003 Lerche
6,837,310 B2 1/2005 Martin
6,915,848 B2 7/2005 Thomeer
8,028,751 B2 10/2011 Pinto
8,201,625 B2 6/2012 Almaguer
(Continued)

FOREIGN PATENT DOCUMENTS

WO WO2015173592 A1 11/2015
WO WO-2022155497 A1 * 7/2022 ..... E21B 43/117
WO WO-2022184731 A1 * 9/2022 ..... E21B 43/117

*Primary Examiner* — Giovanna Wright

(57) ABSTRACT

An apparatus for measuring orientation of a downhole perforating gun system includes a housing or platform for attachment to an interior of a perforating gun, a loading tube, or shape charges for a perforation wireline. The apparatus also includes at least one sensor configured to measure orientation information. The apparatus also includes a communications interface for communicating the measured orientation information to one or more electronic devices communicatively coupled to the apparatus. The apparatus also includes at least one controller configured to cause transmission, using the communications interface, of the orientation information, which corresponds to an orientation of at least one of the perforating gun, the loading tube, or the shape charges, to the one or more electronic devices and initiate a firing sequence of the perforating gun or the shape charges based on a signal received from at least one of the one or more electronic devices.

20 Claims, 17 Drawing Sheets

(56) References Cited

U.S. PATENT DOCUMENTS

| | | | | |
|---|---|---|---|---|
| 8,365,814 | B2 | 2/2013 | Hill | |
| 8,439,114 | B2 | 5/2013 | Parrott | |
| 9,464,508 | B2 | 10/2016 | Lerche | |
| 9,896,920 | B2 | 2/2018 | Holder | |
| 10,598,002 | B2 | 3/2020 | Sites | |
| 11,078,762 | B2 | 8/2021 | Mauldin | |
| 11,619,119 | B1 * | 4/2023 | Roper | E21B 47/024 166/297 |
| 11,624,266 | B2 | 4/2023 | Mauldin | |
| 2010/0051265 | A1 * | 3/2010 | Hurst | E21B 43/1185 166/250.01 |
| 2015/0096752 | A1 * | 4/2015 | Burgos | E21B 47/12 166/297 |
| 2022/0268135 | A1 * | 8/2022 | Eitschberger | E21B 43/119 |
| 2023/0203923 | A1 * | 6/2023 | Eitschberger | E21B 43/119 166/297 |
| 2023/0304384 | A1 * | 9/2023 | Rajaram | E21B 43/118 |
| 2024/0418060 | A1 * | 12/2024 | Prisbell | E21B 47/04 |

* cited by examiner

501

ELECTRONIC DEVICE AND METHOD FOR ORIENTATION-MEASURING DEVICE FOR DOWNHOLE PERFORATIONS

CROSS-REFERENCE TO RELATED APPLICATION AND PRIORITY CLAIM

This application claims priority under 35 U.S.C. § 119(e) to U.S. Provisional Patent Application No. 63/510,022 filed on Jun. 23, 2023, which is hereby incorporated by reference in its entirety.

TECHNICAL FIELD

This disclosure relates generally to downhole plug and perforation systems. More specifically, this disclosure relates to an electronic device and method for an orientation-measuring device for downhole perforations.

BACKGROUND

Hydraulic fracturing (fracking) operations often utilize what is known as a plug and perforation technique in which a section of a well is drilled, cased, cemented, and isolated, and then a wireline is inserted to the end of the well, dubbed "toe prep." The wireline includes perforating guns that each fire an explosive discharge into a section of the rock layer downhole to create perforations in the section of rock layer. The wireline is then removed from the well and fluid is pumped into the perforated well to fill the perforations in the rock layer with the fluid at high pressure to fracture the rock layer. This section of the well can then be plugged, and the process can be repeated for a next section of the well.

However, it is a common problem in the industry that, once the perforating guns are inserted downhole into the section of the well to be perforated, the orientation of the perforating guns is not known and cannot be detected. This can cause many problems, including problems with perforating in an undesirable or incorrect direction. For example, in well completions featuring advanced in-well technologies, such as permanent optical fiber, the alignment of each shot must be confirmed within a narrow window to avoid expensive hardware damage.

SUMMARY

This disclosure relates to an electronic device and method for an orientation-measuring device for downhole perforations.

In one example embodiment, an electronic device includes a housing or platform for attachment to an interior of a perforating gun for a perforation wireline, at least one sensor configured to detect orientation information in real-time or based on an adjustable transmission rate, at least one controller that controls the at least one sensor, and a communications interface for communicating the detected orientation information to one or more other electronic devices communicatively coupled to the electronic device. At least the housing or platform, the at least one sensor, the at least one controller, and the communications interface form an orientation-measuring device that is the electronic device. The at least one controller is configured to cause transmission, using the communications interface, of the orientation information of the orientation-measuring device, which corresponds to an orientation of the perforating gun, to the one or more other electronic devices, and initiate a firing sequence of the perforating gun based on a signal received from at least one of the one or more other electronic devices.

In another example embodiment, an apparatus for measuring orientation of a downhole perforating gun system includes a housing or platform for attachment to an interior of a perforating gun, a loading tube, or shape charges for a perforation wireline. The apparatus also includes at least one sensor configured to measure orientation information of the perforating gun, the loading tube, or the shape charges, wherein the at least one sensor includes one or more of a gyroscope, accelerometer, or magnetometer. The apparatus also includes at least one controller that controls the at least one sensor. The apparatus also includes a communications interface for communicating the measured orientation information to one or more electronic devices communicatively coupled to the apparatus. The at least one controller is configured to cause transmission, using the communications interface, of the orientation information, which corresponds to an orientation of at least one of the perforating gun, the loading tube, or the shape charges, to the one or more electronic devices. The at least one controller is also configured to initiate a firing sequence of the perforating gun or the shape charges based on a signal received from at least one of the one or more electronic devices.

In one or more of the above examples, the apparatus is at least a part of a perforation switch that initiates a perforation of the perforating gun.

In one or more of the above examples, the apparatus is at least part of an electronic detonator disposed inside of the perforating gun.

In one or more of the above examples, the at least one controller is further configured to cause transmission, to the one or more electronic devices or another downhole controller, of data corresponding to the measured orientation information of the shape charges.

In one or more of the above examples, the at least one controller is further configured to receive data from the one or more electronic devices corresponding to an orientation range allowed to perforate the shape charges.

In one or more of the above examples, the measured orientation is measured in three degrees of freedom, 6 degrees of freedom, or 9 degrees of freedom.

In one or more of the above examples, the at least one sensor is configured to measure the orientation information in real-time or based on an adjustable transmission rate.

In one or more of the above examples, the at least one controller is further configured to receive an acceptable orientation range to initiate perforation.

In one or more of the above examples, the acceptable orientation range to initiate perforation is +/−20 degrees from a center alignment.

In one or more of the above examples, the at least one controller is further configured to receive a transmission indicating that the firing sequence of the perforating gun or the shape charges is not confirmed and initiate a re-firing sequence of the perforating gun or the shape charges.

In another example embodiment, a method includes sending a downhole perforating gun system into a portion of a wellbore, the downhole perforating gun system including an apparatus having a housing or platform for attachment to an interior of a perforating gun, a loading tube, or shape charges for a perforation wireline. The method also includes measuring, using at least one sensor of the apparatus, orientation information of the perforating gun, the loading tube, or the shape charges, wherein the at least one sensor includes one or more of a gyroscope, accelerometer, or magnetometer. The method also includes transmitting, by a controller of the apparatus that controls the at least one sensor and using a communications interface of the apparatus, the orientation information, which corresponds to an orientation of at least one of the perforating gun, the loading tube, or the shape charges, to one or more electronic devices communicatively coupled to the apparatus. The method also includes initiating a firing sequence of the perforating gun or shape charges based on a signal received from at least one of the one or more electronic devices.

In one or more of the above examples, the apparatus is at least a part of a perforation switch that initiates a perforation of the perforating gun.

In one or more of the above examples, the apparatus is at least part of an electronic detonator disposed inside of the perforating gun.

In one or more of the above examples, the method also includes transmitting, to the one or more electronic devices or another downhole controller, data corresponding to the measured orientation information of the shape charges.

In one or more of the above examples, the method also includes receiving data from the one or more electronic devices corresponding to an orientation range allowed to perforate the shape charges.

In one or more of the above examples, the measured orientation is measured in three degrees of freedom, 6 degrees of freedom, or 9 degrees of freedom.

In one or more of the above examples, the method further includes measuring, using the at least one sensor, the orientation information in real-time or based on an adjustable transmission rate.

In one or more of the above examples, the method further includes receiving an acceptable orientation range to initiate perforation.

In one or more of the above examples, the acceptable orientation range to initiate perforation is +/−20 degrees from a center alignment.

In one or more of the above examples, the method further includes receiving a transmission indicating that the firing sequence of the perforating gun or the shape charges is not confirmed and initiating a re-firing sequence of the perforating gun or the shape charges.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

As used here, terms and phrases such as "have," "may have," "include," or "may include" a feature (like a number, function, operation, or component such as a part) indicate the existence of the feature and do not exclude the existence of other features. Also, as used here, the phrases "A or B," "at least one of A and/or B," or "one or more of A and/or B" may include all possible combinations of A and B. For example, "A or B," "at least one of A and B," and "at least one of A or B" may indicate all of (1) including at least one A, (2) including at least one B, or (3) including at least one A and at least one B. Further, as used here, the terms "first" and "second" may modify various components regardless of importance and do not limit the components. These terms are only used to distinguish one component from another. For example, a first user device and a second user device may indicate different user devices from each other, regardless of the order or importance of the devices. A first component may be denoted a second component and vice versa without departing from the scope of this disclosure.

It will be understood that, when an element (such as a first element) is referred to as being (operatively or communicatively) "coupled with/to" or "connected with/to" another element (such as a second element), it can be coupled or connected with/to the other element directly or via a third element. In contrast, it will be understood that, when an element (such as a first element) is referred to as being "directly coupled with/to" or "directly connected with/to" another element (such as a second element), no other element (such as a third element) intervenes between the element and the other element.

As used here, the phrase "configured (or set) to" may be interchangeably used with the phrases "suitable for," "having the capacity to," "designed to," "adapted to," "made to," or "capable of" depending on the circumstances. The phrase "configured (or set) to" does not essentially mean "specifically designed in hardware to." Rather, the phrase "configured to" may mean that a device can perform an operation together with another device or parts. For example, the phrase "processor configured (or set) to perform A, B, and C" may mean a generic-purpose processor (such as a CPU or application processor) that may perform the operations by executing one or more software programs stored in a memory device or a dedicated processor (such as an embedded processor) for performing the operations.

The terms and phrases as used here are provided merely to describe some embodiments of this disclosure but not to limit the scope of other embodiments of this disclosure. It is to be understood that the singular forms "a," "an," and "the" include plural references unless the context clearly dictates otherwise. All terms and phrases, including technical and scientific terms and phrases, used here have the same meanings as commonly understood by one of ordinary skill in the art to which the embodiments of this disclosure belong. It will be further understood that terms and phrases, such as those defined in commonly-used dictionaries, should be interpreted as having a meaning that is consistent with their meaning in the context of the relevant art and will not be interpreted in an idealized or overly formal sense unless expressly so defined here. In some cases, the terms and phrases defined here may be interpreted to exclude embodiments of this disclosure.

Examples of an "electronic device" according to embodiments of this disclosure may include at least one of a smartphone, a tablet personal computer (PC), a mobile phone, a video phone, a desktop PC, a laptop computer, a netbook computer, a workstation, a personal digital assistant (PDA), or a wearable device (such as smart glasses, a head-mounted device (HMD). Note that, according to various embodiments of this disclosure, an electronic device may be one or a combination of the above-listed devices. According to some embodiments of this disclosure, the electronic device may also be an orientation-measuring switch or orientation-measuring device as further described in this disclosure. Electronic devices disclosed herein are not limited to the above-listed devices and may include any other electronic devices now known or later developed.

In the following description, electronic devices are described with reference to the accompanying drawings, according to various embodiments of this disclosure. As used here, the term "user" may denote a human or another device (such as an artificial intelligent electronic device) using the electronic device.

Definitions for other certain words and phrases may be provided throughout this patent document. Those of ordinary skill in the art should understand that in many if not most instances, such definitions apply to prior as well as future uses of such defined words and phrases.

None of the description in this application should be read as implying that any particular element, step, or function is an essential element that must be included in the claim scope. The scope of patented subject matter is defined only by the claims. Moreover, none of the claims is intended to invoke 35 U.S.C. § 112(f) unless the exact words "means for" are followed by a participle. Use of any other term, including without limitation "mechanism," "module," "device," "unit," "component," "element," "member," "apparatus," "machine," "system," "processor," or "controller," within a claim is understood by the Applicant to refer to structures known to those skilled in the relevant art and is not intended to invoke 35 U.S.C. § 112(f).

BRIEF DESCRIPTION OF THE DRAWINGS

For a more complete understanding of this disclosure and its advantages, reference is now made to the following description taken in conjunction with the accompanying drawings, in which like reference numerals represent like parts.

DETAILED DESCRIPTION

Figure 1:
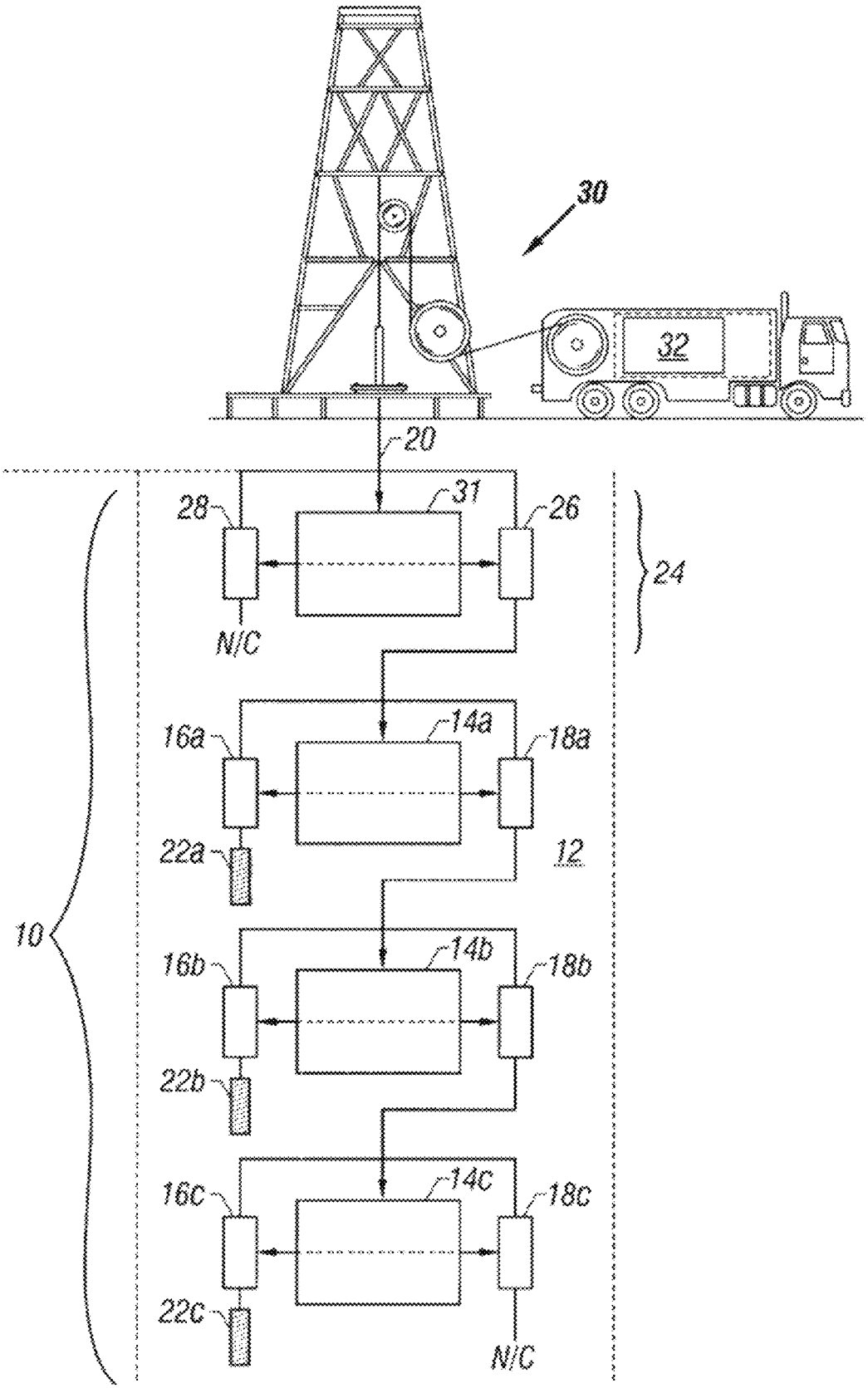
FIG. 1 illustrates an example perforating system in accordance with this disclosure.

FIGS. 1 through 9, discussed below, and the various embodiments of this disclosure are described with reference to the accompanying drawings. However, it should be appreciated that this disclosure is not limited to these embodiments, and all changes and/or equivalents or replacements thereto also belong to the scope of this disclosure. The same or similar reference denotations may be used to refer to the same or similar elements throughout the specification and the drawings.

As noted above, hydraulic fracturing (fracking) operations often utilize what is known as a plug and perforation technique in which a section of a well is drilled, cased, cemented, and isolated, and then a wireline is inserted to the end of the well, dubbed "toe prep." The wireline includes perforating guns that each fire an explosive discharge into a section of the rock layer downhole to create perforations in the section of rock layer. The wireline is then removed from the well and fluid is pumped into the perforated well to fill the perforations in the rock layer with the fluid at high pressure to fracture the rock layer. This section of the well can then be plugged, and the process can be repeated for a next section of the well.

However, it is a common problem in the industry that, once the perforating guns are inserted downhole into the section of the well to be perforated, the orientation of the perforating guns is not known and cannot be detected. This can cause many problems, including problems with perforating in an undesirable or incorrect direction, which can consequently affect the well's production quantity. For example, in well completions featuring advanced in-well technologies, such as permanent optical fiber, the alignment of each shot must be confirmed within a narrow window to avoid expensive hardware damage. Guns that self-orient using gravity such as via a weight bar have been introduced into the industry. Some self-orienting guns include a weight bar system that is external to the guns and can be used to orient a complete gun string in a single configuration, i.e., all the guns are locked together and rotate together. Some self-orienting gun systems use an internal weighted ballast in each individual gun so that the guns rotate/orient independently of each other. However, such self-orienting guns still lack the ability to monitor their actual orientation in real-time, such that the user must merely rely on the mechanical self-orientation of the guns and hope that the guns orient themselves downhole for firing in the proper direction, leading to unpredictable results and possible damage.

This disclosure provides an electronic device and method for an orientation-measuring switch or orientation-measuring device for downhole perforations. This orientation-measuring switch is installed in the perforating guns and can also be used to trigger downhole firing of the perforating guns. The orientation-measuring switch includes sensors that enable detection of gun orientation, such as one or more gyroscopes and/or accelerometers. The orientation-measuring switch may also include other sensors to detect other downhole conditions such as downhole temperature, downhole head voltages for each gun in the toolstring, detonator resistance, etc. The orientation-measuring switch can communicate these various readings up the toolstring so that other devices such as surface electronic devices can monitor, display, and/or log the data provided by the orientation-measuring switch.

In various embodiments, the orientation-measuring device can be a device separate from a switch. In such embodiments, the orienting device can be a card or electronic board with at least an orientation sensor (e.g., gyroscopic sensor) and also can include other sensors such as one or more accelerometers. In various embodiments, the orientation-measuring device can be part of an electronic detonator that is used to directly fire the perforating guns, such that the electronic detonator has orientation reading capabilities. Whether the orientation-measuring device is, or part of, a perforation switch, an electronic detonator, or a separate device installed within the perforating gun, the orientation-measuring device provides a cost-efficient downhole solution that is portable enough to possibly be installed in every single charge tube in the toolstring or bottom hole assembly (BHA) (including self-aligning/rotating charge tubes) which holds the explosives and shape charges. Additionally, the orientation-measuring device provides accurate perforation and/or acceleration data for each individual gun in the toolstring.

In some embodiments, when used with self-orienting guns having an external weight bar system, a single orientation-measuring device can be installed to monitor the position of the full gun string and therefore all perforating guns. In some embodiments, when used with self-orienting guns having an internal ballast system, multiple orientation-measuring devices can be installed, such as one in each gun, to monitor each gun individually.

FIG. 1 illustrates an example perforating system 10 in accordance with this disclosure. The system 10 is for use in a well 12 and provides an example of an operational environment according to embodiments of this disclosure. The perforating system 10 in the illustrated embodiment includes a multi-gun string having a control system that may include multiple control units 14A-14C that control activation of guns or charges in the string. Each control unit 14 may be coupled to switches 16 and 18 (illustrated as 16A-16C and 18A-18C). The cable switches 18A-18C are controllable by the control units 14A-14C, respectively, between on and off positions to enable or disable current flow through one or more electrical cables 20 (which may be located in a wireline, for example) to successive control units. The switches 16A-16C are each coupled to a detonating device 22 (illustrated as 22A-22C) that are installed in a perforating gun.

The switches 16A-16C are orientation-measuring switches as described in the various embodiments of this disclosure. These orientation-measuring switches 16A-16C include sensors that enable detection of gun orientation, such as one or more gyroscopes and/or accelerometers. The orientation-measuring switch may also include other sensors to detect other downhole conditions such as downhole temperature, downhole head voltages for each gun in the toolstring, detonator resistance, etc. The orientation-measuring switch can communicate these various readings up the toolstring so that other devices such as surface electronic devices can monitor, display, and/or log the data provided by the orientation-measuring switch. The detonating device may be a standard detonator, a capacitor discharge unit (CDU), or other initiator coupled to initiate a detonating cord to fire shaped charges or other explosive devices in the perforating gun. If activated to an on position, a switch 16 allows electrical current to flow to a coupled detonating device 22.

In the illustrated embodiment, the switch 18A controls current flow to the control unit 14B, and the switch 18B controls current flow to the control unit 14C. For added safety, a dummy detonator 24 may optionally be coupled at the top of the string. The dummy detonator 24 is first energized and set up before the guns or charges below may be detonated. The dummy detonator 24 includes a cable switch 26 that controls current flow to the first control unit 14A. The dummy detonator 24 also includes a control unit 31 as well as a dummy switch 28, which is not coupled to a detonator.

The one or more electrical cables 20 extend through a wireline or other carrier to surface equipment (generally indicated as 30), which may include a surface system 32, which may be a general-purpose or special-purpose computer, any other microprocessor- or microcontroller-based system, or any control device. The surface system 32 is configurable by tool activation software to issue commands to the downhole tool (e.g., perforating system 10) to set up and to selectively activate one or more of the control units 14.

Bi-directional electrical communication (by digital signals or series of tones, for example) between the surface system 32 and control units 14 downhole may occur over one or more of the electrical cables 20. The electrical communication according to one embodiment may be bi-directional so that information of the control units 14 may be monitored by the tool activation software in the surface system 32. The information, which may include the control units' identifiers, status, and auxiliary data or measurements, for example, is received by the system 32 to verify correct selection and status information. This may be particularly advantageous where an operator at the wellsite desires to confirm which of the devices downhole has been selected before actual activation (or detonation in the case of a perforating gun or explosive).

In other embodiments, a system such as a computer or other control device may be lowered downhole with the tool string. This system may be an interface through which a user may issue commands (e.g., by speech recognition or keyboard entries). In one embodiment of the invention, each control unit 14 may be assigned an address by the tool activation software in the surface system 32 during system initialization. One advantage provided by the soft-addressing scheme is that the control units 14 do not need to be hard-coded with predetermined addresses. This reduces manufacturing complexity in that a generic control unit can be made. Another advantage of soft-addressing is that the control units may be assigned addresses on the fly to manipulate the order in which devices downhole are activated. In other embodiments, the control units 14 may be hard coded with pre-assigned addresses or precoded during assembly. Additional information may be coded into the control units, including the type of device, order number, run number, and other information.

The tool activation system according to embodiments of the invention also allows defective devices in the string to be bypassed or "skipped over." Thus, a defective device in a multi-device string (such as a gun string) would not render the remaining parts of the string inoperable.

Although FIG. 1 illustrates one example of a perforating system 10, various changes may be made to FIG. 1. For example, the perforating system 10 could include any suitable number of each component in any suitable arrangement. In general, perforating systems can come in a wide variety of configurations, and FIG. 1 does not limit the scope of this disclosure to any particular configuration. Also, while FIG. 1 illustrates one operational environment in which various features disclosed in this patent document can be used, these features could be used in any other suitable system. Downhole perforation systems are also described in U.S. Pat. No. 6,604,584, which is incorporated by reference herein in its entirety.

Figure 2:
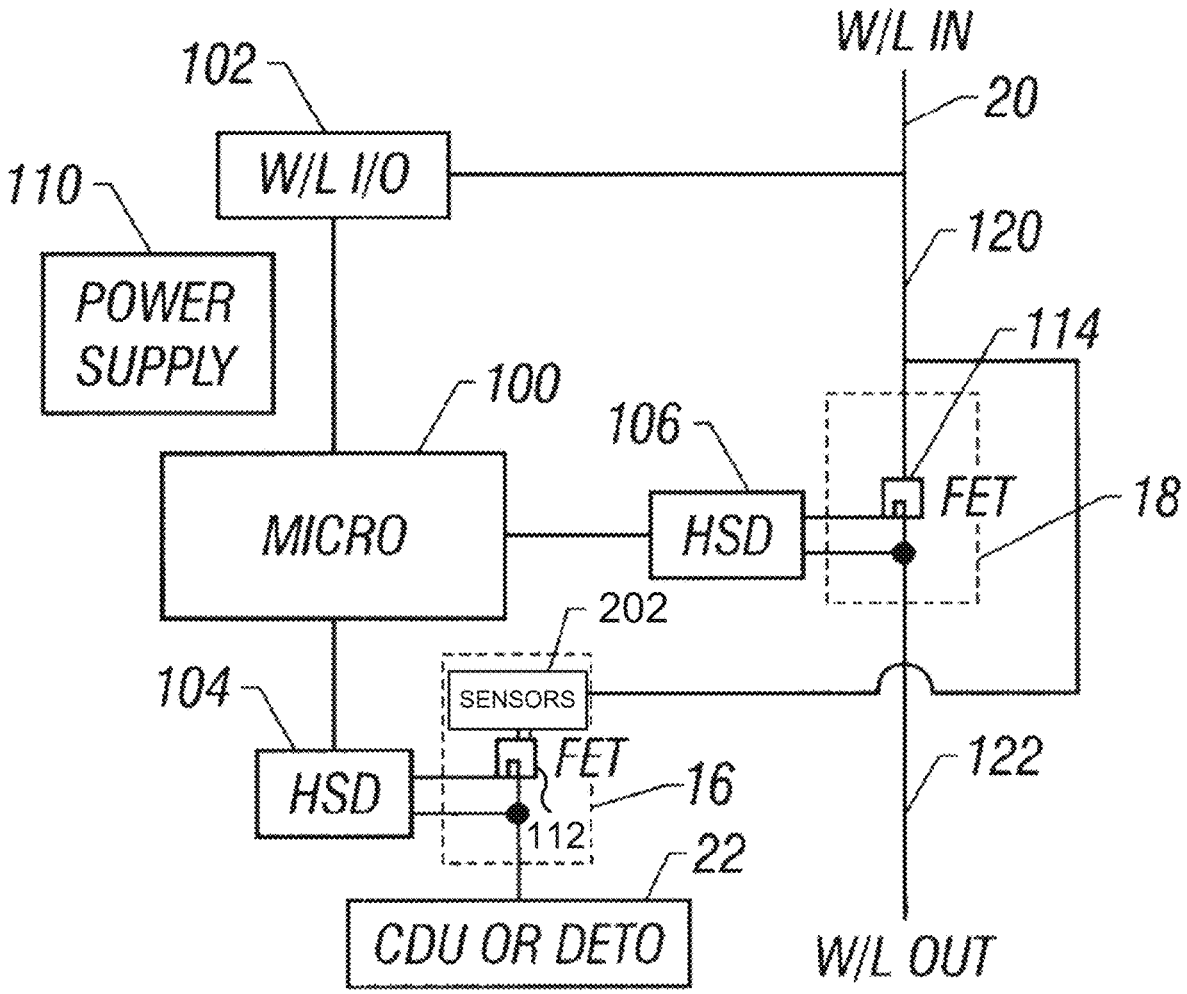
FIG. 2 illustrates a control unit and an orientation-measuring perforation switch in accordance with this disclosure.

FIG. 2 illustrates a control unit 14 and an orientation-measuring perforation switch 16 in accordance with this disclosure. A microcontroller 100 forms the processing core of the control unit 14, which communicates with other equipment or electronic devices (located downhole or at the surface) through an input/output (I/O) circuit 102 and the electrical cable 20. The components of the control unit 14 may be powered by a power supply 110. Other types of control devices may be substituted for the microcontroller 100, including microprocessors, application specific integrated circuits (ASICs), programmable gate arrays (PGAs), discrete devices, and the like. Although the description of some embodiments refer to microcontrollers, it is to be understood that the invention is not to be limited to such embodiments. In this application, the term control device may refer to a single integrated device or a plurality of devices. In addition, the control device may include firmware or software executable on the control device.

In one embodiment, the microcontroller 100 may control the switches 16 and 18 through high side drivers (HSDs) 104 and 106, respectively. HSDs can be included in the embodiment of FIG. 2 since positive polarity voltages (typically in the hundreds of volts, for example) may be transmitted down the electrical cable 20. The microcontroller 100 in the illustrated embodiment may be biased between a voltage provided by the power supply 110 and ground voltage. The outputs of the microcontroller 100 may be at TTL levels. To activate the switches 16 and 18, the HSDs 104 and 106, respectively, convert TTL-level signals to high voltage signals (e.g., one or two threshold voltages above the electrical cable voltage) to turn on field effect transistors (FETs) 112 and 114. In further embodiments, HSDs may not be needed if negative polarity signals are transmitted down the electrical cable 20. Other types of switches may be used, including, for example, switches implemented with bipolar transistors and mechanical-type switches.

The microcontroller 100 is adapted to receive commands from the tool activation program in the surface system 32 so that it may selectively activate FETs 112 and 114 as indicated in the commands. When turned on, the transistor 114 couples two sections 120 and 122 of the electrical cable 20. Likewise, the transistor 112 couples the signal or signals in the upper section 120 of the cable 20 to the detonating device 22. In addition, each microcontroller 100 may be configured according to commands issued by the tool activation program.

As further illustrated in FIG. 2, the orientation-measuring switch 16 includes one or more sensors 202 connected to the wireline. The sensors 202 can include one or more gyroscopes and/or accelerometers to enable detection of gun orientation, as well as other data such as speed/acceleration of the perforating gun, real-time travel slope or well inclination (e.g., 90 degrees, 45 degrees), etc., as it travels through the well. In some cases, orientation may not be communicated continuously, but may only be communicated right before perforation to provide a "screenshot" of the current orientation pre-perforation. The sensors 202 can also include sensors to detect other downhole conditions such as downhole temperature, downhole head voltages for each gun in the toolstring, detonator resistance, etc. The orientation-measuring switch 16 can communicate these various readings up the wireline so that other devices such as surface electronic devices can monitor, display, and/or log the data provided by the orientation-measuring switch.

The various embodiments of the orientation-measuring switch described in this disclosure can operate using particular stable communications protocol, has a higher level of control than mechanical switches, saves time before downhole operations, is radio-frequency (RF) and electrostatic discharge (ESD) safe, is made of rugged materials to survive downhole insertions and retrievals, and can include features such as detonator detection, detonator resistance measurement, downhole head voltage reading for each gun in the toolstring, and downhole temperature measurement.

Although FIG. 2 illustrates one example of a control unit 14 and an orientation-measuring switch 16, various changes may be made to FIG. 2. For example, the diagram illustrated could include any suitable number of each component in any suitable arrangement. In general, control units and perforation switches can come in a wide variety of configurations, and FIG. 2 does not limit the scope of this disclosure to any particular configuration. Also, while FIG. 2 illustrates one operational environment in which various features disclosed in this patent document can be used, these features could be used in any other suitable system or environment. For instance, in various embodiments, instead of including orientation sensors, as well as other sensors, in the switch 16, a separate orientation device could be installed in the toolstring that is a card or board including the orientation sensor and various other sensors. This separate orientation device can detect orientation and transmit orientation data, leaving the switch 16 to function just as a detonator switch in such embodiments. These separate orientation devices are also capable of measuring the orientation of self-orienting guns individually, to allow for measuring the orientation of each gun relative to the well.

Figure 3A:
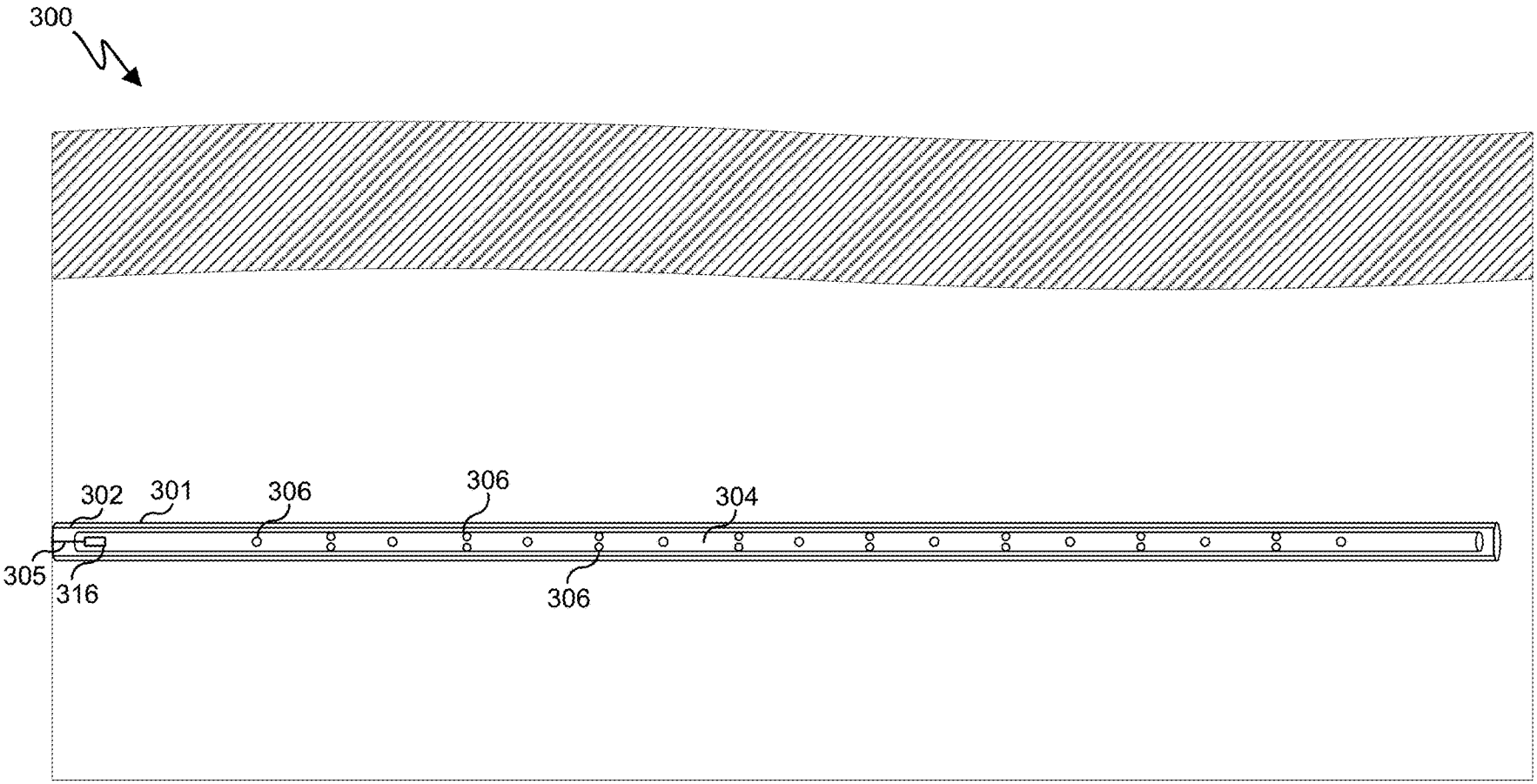
FIGS. 3A and 3B illustrate an example horizontal perforation operation environment in accordance with embodiments of this disclosure.
Figure 3B:
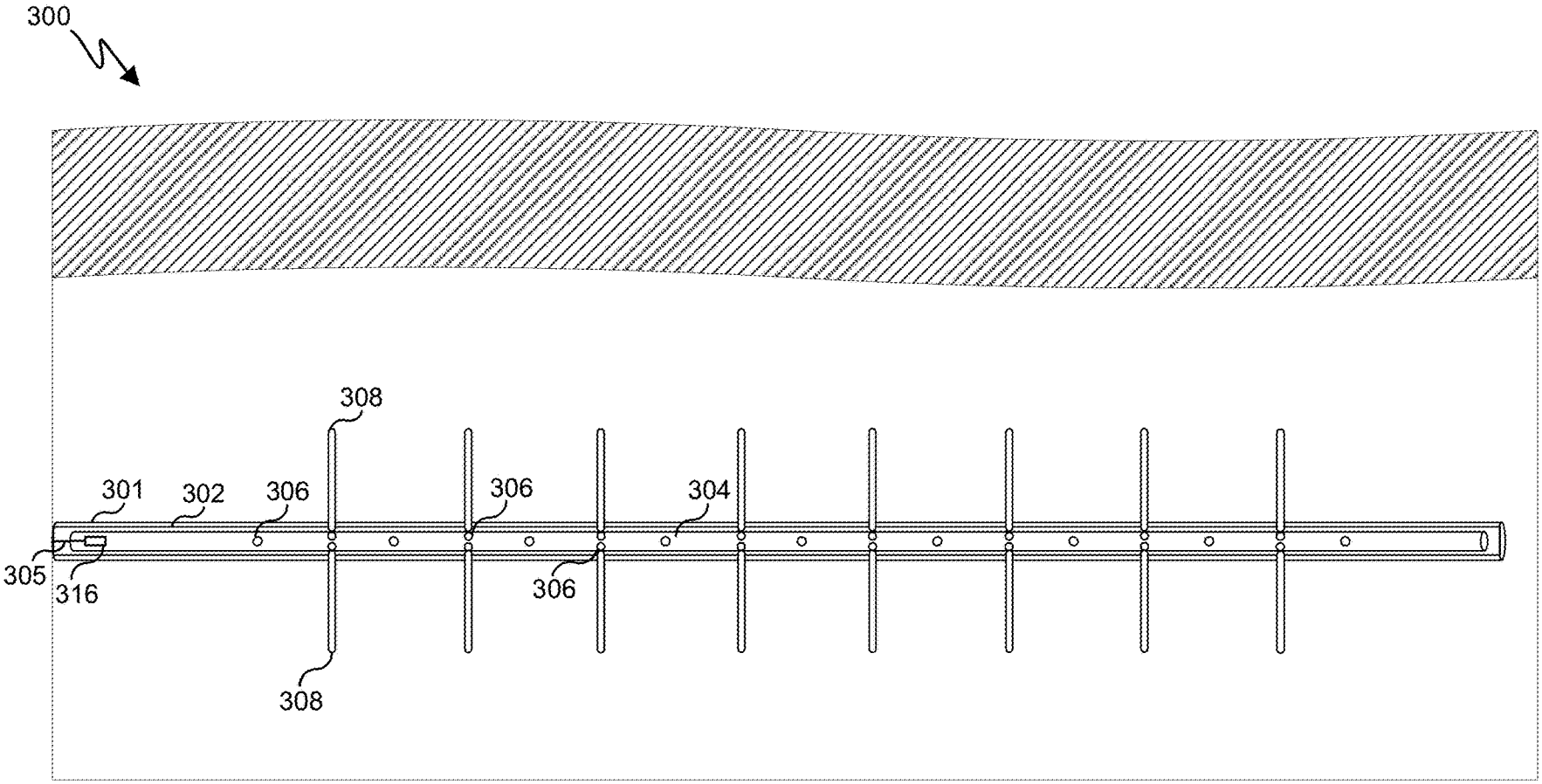

FIGS. 3A and 3B illustrate an example horizontal perforation operation environment 300 in accordance with embodiments of this disclosure. Although FIG. 1 shows one embodiment with various downhole components including the orientation-measuring switch 16, the orientation-measuring switches can be extremely effective in horizontal perforation and fracking. For example, as shown in FIGS. 3A and 3B, after drilling a horizontal section in a rock or shale formation, (i.e., the lateral), the drill pipe and bit are removed from the wellbore 301 and production casing 302 is inserted into the length of a wellbore 301. Cement is pumped through and out of the casing 302 to fill the wellbore 301 to secure the wellbore 301 and prevent hydrocarbons and other fluids seeping out. As illustrated in FIGS. 3A and 3B, the operation environment 300 includes inserting a perforating gun 304 by a wireline 305 into the casing 302 in a targeted area of the horizontally drilled section. In some embodiments, the perforating gun 304 can be a self-orienting gun that includes a mechanical orienting device such as a weight bar.

The perforating gun includes installed and fixed therein at least one orientation-measuring device 316. The orientation-measuring device 316 includes one or more sensors such as a gyroscopic sensor or gyroscope. In some embodiments, the orientation-measuring device 316 is addressable, while in other embodiments the orientation-measuring device 316 can be unaddressable, (e.g., since orientation-measuring devices can be daisy-chained and can thus power up/wake up in a sequential order, the user/control system, etc. can still identify and control the downhole board without needing an address, and the control unit can just use the orientation-measuring device's order in the sequence rather than an address). The orientation-measuring device 316 can also include an acceleration sensor, or accelerometer, or the accelerometer and the gyroscope can be part of the same hardware device within the orientation-measuring device (e.g., an inertial measurement unit (IMU)). In some embodiments, the orientation-measuring device 316 is part of a detonator switch, while in other embodiments the orientation-measuring device 316 can be a standalone device installed separately within the perforating gun. As also described herein, in various embodiments, the sensors of the orientation-measuring device 316 can also detect other downhole conditions such as downhole temperature, downhole head voltages for each gun in the toolstring, detonator resistance, etc.

Figure 4A:
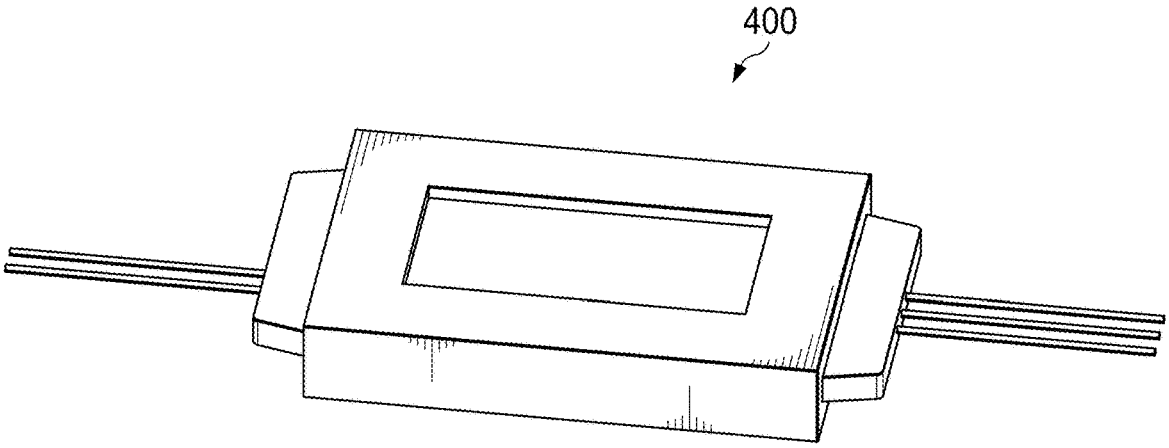
FIGS. 4A and 4B illustrate an example orientation-measuring device in accordance with this disclosure.
Figure 4B:
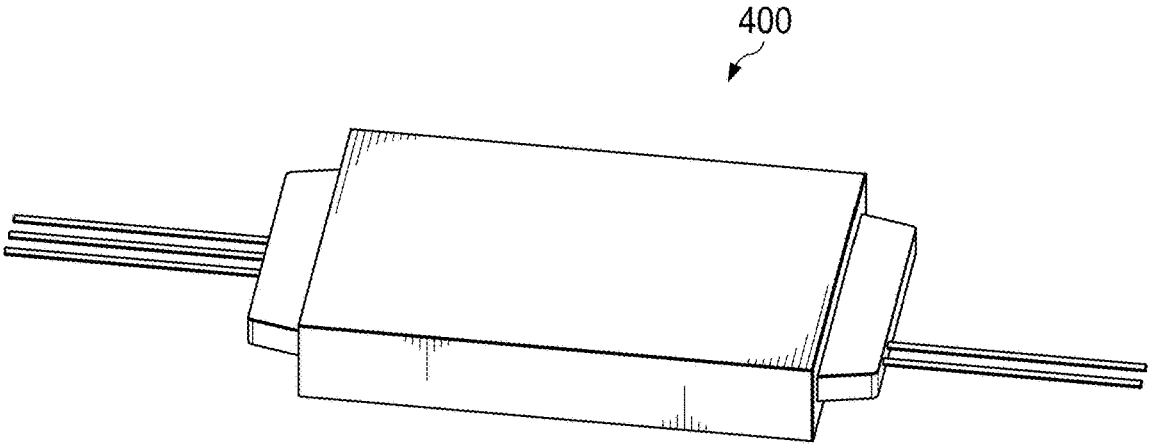
Figure 4C:
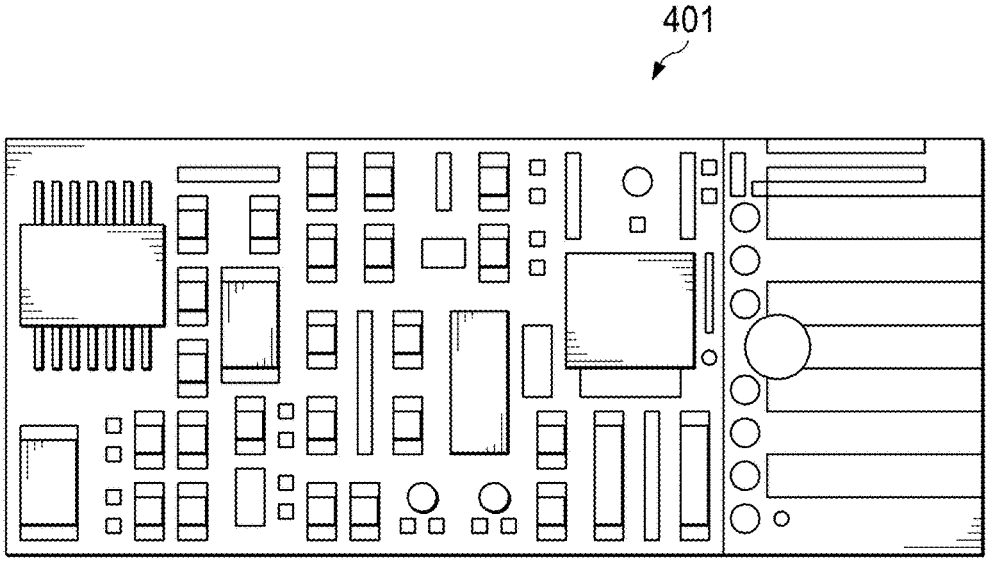
FIG. 4C illustrates an example orientation-measuring device for direct connection to board in accordance with this disclosure.

The orientation-measuring devices of the various embodiments of this disclosure allow for a level of control over the perforation process unlike traditional switches because the orientation-measuring devices can communicate the status and environmental conditions downhole, including critical downhole measurements such as detonator health, node voltages at each gun, downhole temperatures, casing collar locator (CCL) data, downhole and surface acceleration data, etc. In some embodiments in which the orientation-measuring device is an orientation-measuring switch, it can also be a combination detonation switch and detonator probing plug switch. FIGS. 4A and 4B illustrate an example orientation-measuring device 400 in accordance with this disclosure, which can be the orientation-measuring device 316. In some embodiments, the orientation-measuring device can have a housing that houses the electronic components of the orientation-measuring device, as well as wires extending therefrom for communicatively connecting the orientation-measuring device to other devices. In some embodiments, the orientation-measuring device may not have a housing, but rather a platform (e.g., a PCB board) the board can simply be connected to the system and mounted within the perforating gun. Additionally, in some embodiments such as shown in FIG. 4C, the orientation-measuring device can be an orientation-measuring device 401 that may not require wires to be connected but can be connected via contacts or other ways directly to a PCB board.

Figure 5A:
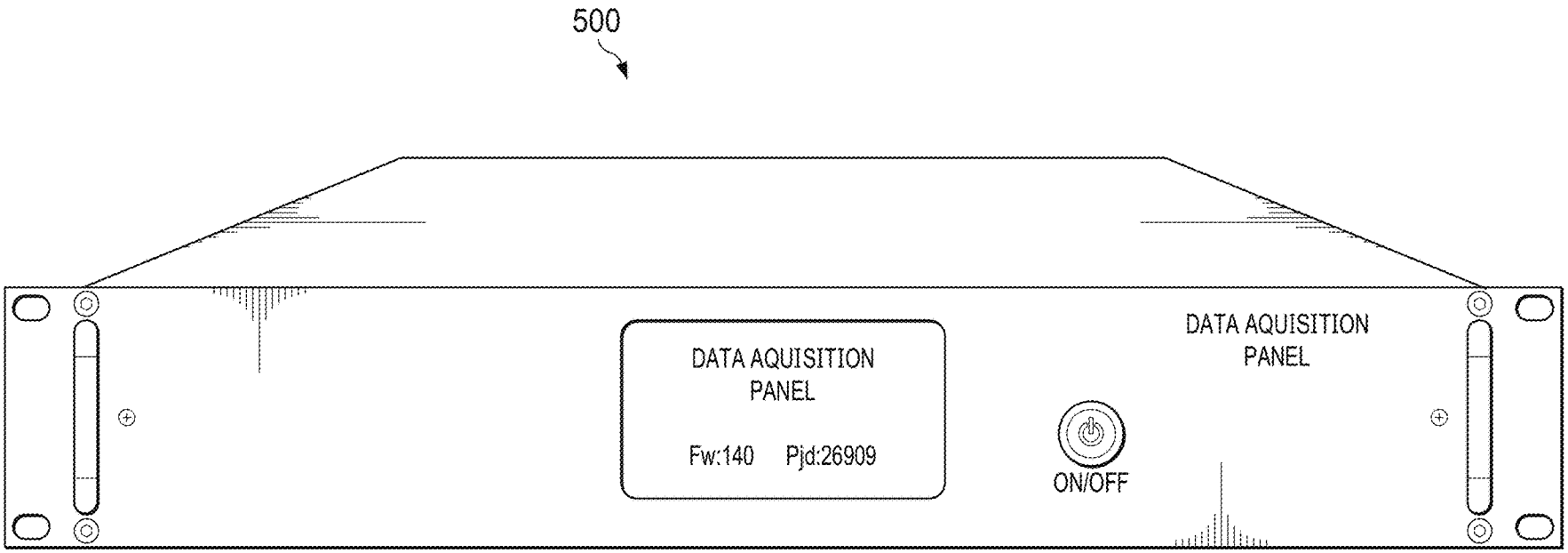
FIGS. 5A-5C illustrate an example data acquisition and logging panel in accordance with this disclosure.
Figure 5B:
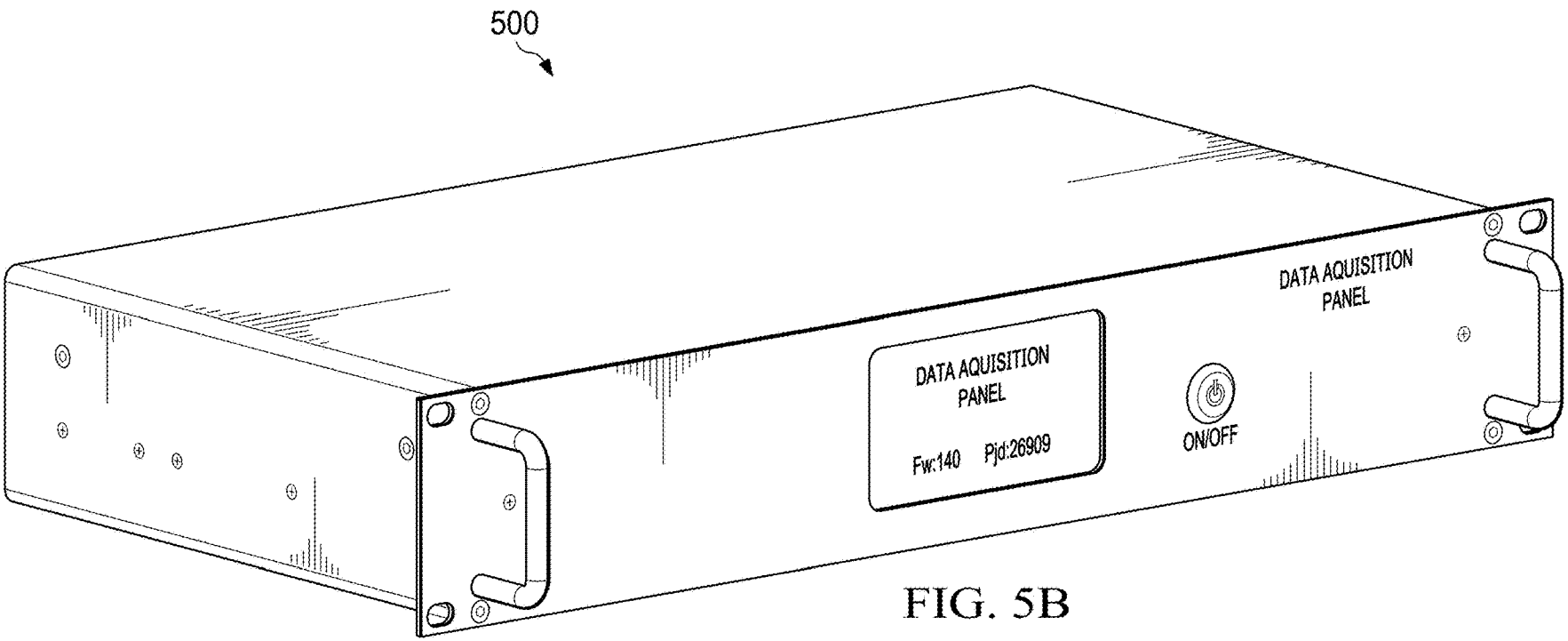
Figure 5C:
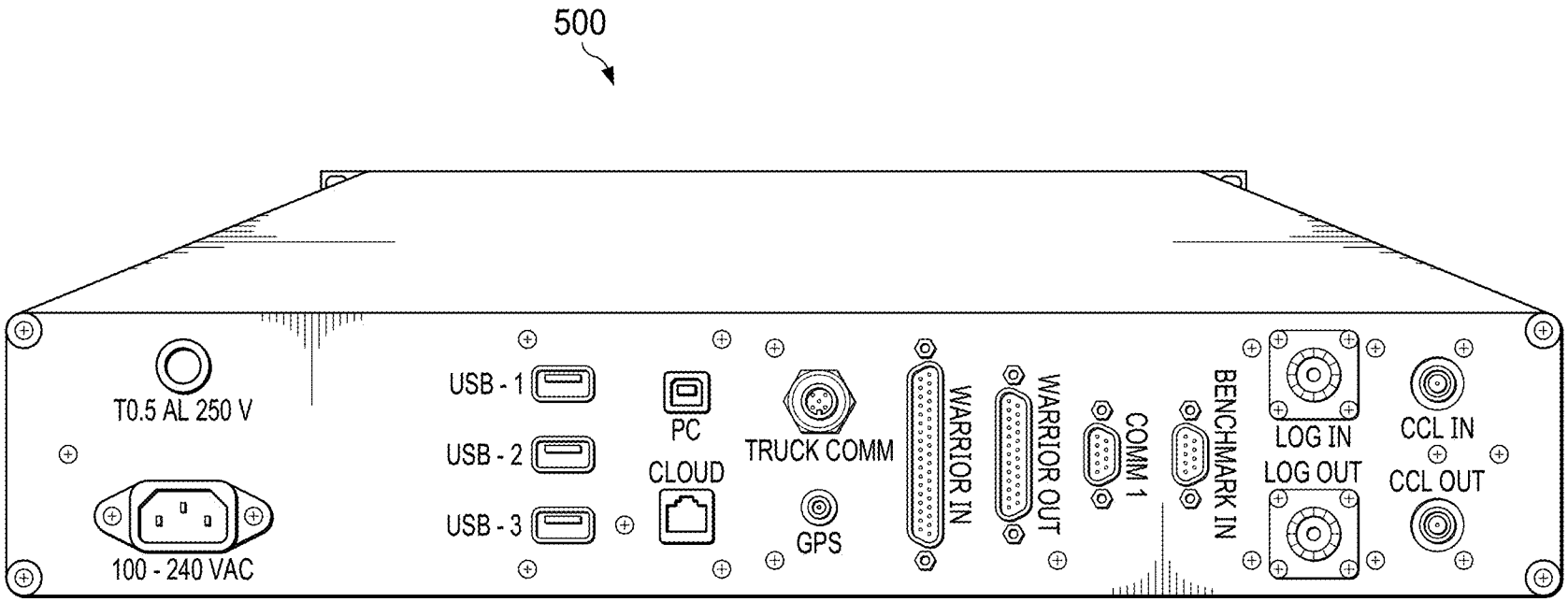

The orientation-measuring device 316 can communicate these various readings up the wireline 305 so that other devices such as surface electronic devices can monitor, display, and/or log the data provided by the orientation-measuring device 316. For example, a data acquisition and logging panel electronic device can be installed at the surface that is connecting via the wireline 305 to the orientation-measuring device 316. The data acquisition and logging panel can be configured to provide various features including storing and displaying CCL, depth, speed and line tension logs, real-time shot verification display, fast and sensitive current and voltage measurements, auto-scanning after firing, short and open circuit detection, connected detonator check, igniter/release tool resistance check, real-time remote monitoring, telemetry auto-gain settings, etc. The data acquisition and logging panel can be of a rack mount design, such as shown in FIGS. 5A-5C, which illustrate an example data acquisition and logging panel 500 in accordance with this disclosure. The data acquisition and logging panel can interface with the wireline cable and other device such as a shooting panel. In some embodiments, a shooting panel may not be used, in which case the data acquisition and logging panel can connect to any other power supply for triggering detonations. A telemetry link can be established with the perforating devices and the panel can inventory the string. Once guns are confirmed to be on depth, arm and fire commands can be sent to each detonator switch to initiate a firing process. The panel can monitor the voltage to verify that each successful fire has been achieved.

Figure 5D:
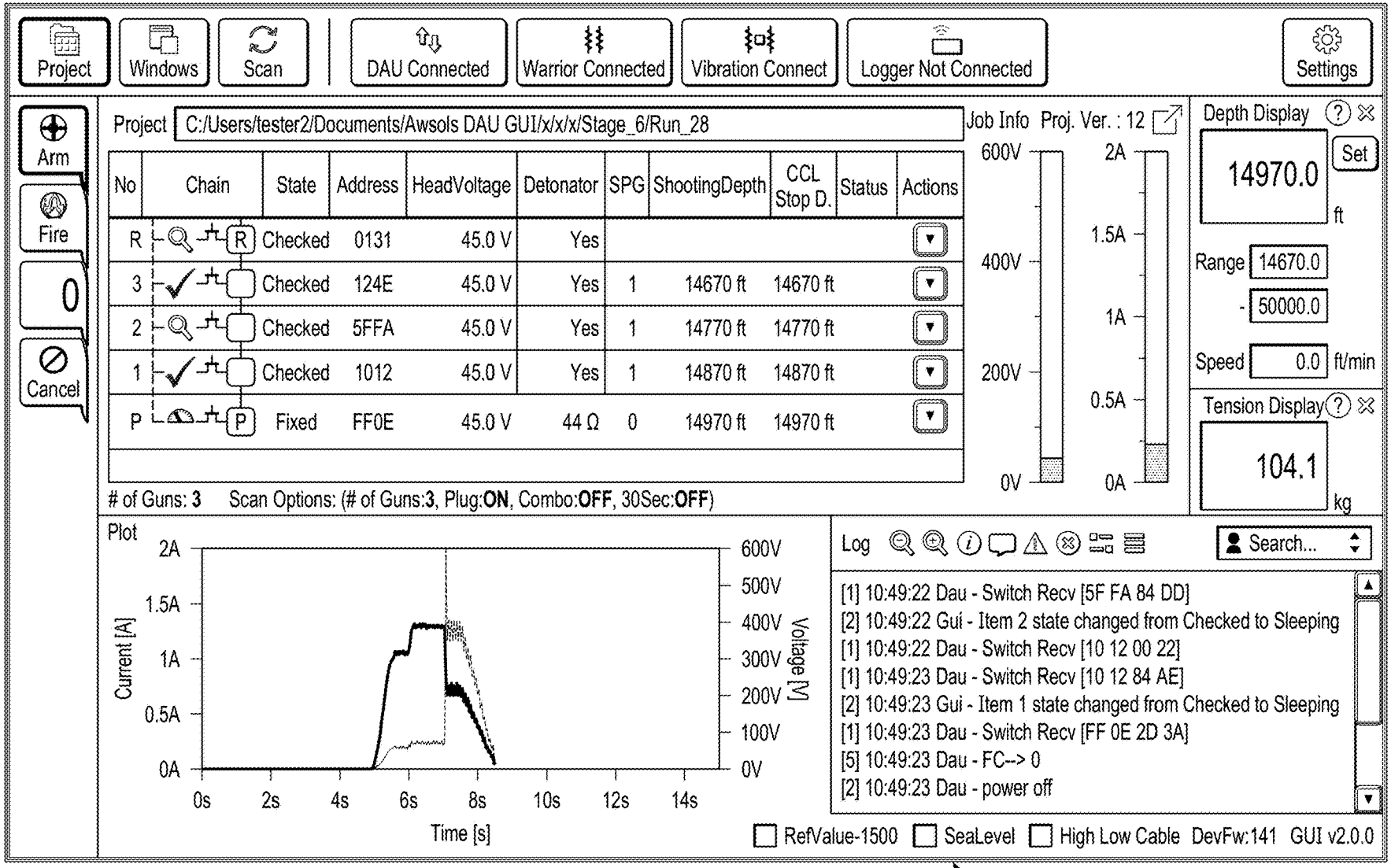
FIG. 5D illustrates an example display or GUI that can be provided by the data acquisition and logging panel in accordance with this disclosure.

The data acquisition and logging panel can have various connections such as power source connections (110 v/240 v), port(s) for connections to other devices (e.g., a USB port for connecting to a PC), an Ethernet port for remote streaming, a wireline connection or port for communicating along the wireline cable, CCL, shooting panel, etc., a winch for an encoder and/or transducer, truck communications connections for drum control, GPS, benchmark controls, etc. FIG. 5D illustrates an example display or GUI that can be provided by the data acquisition and logging panel in accordance with this disclosure. As shown in the example of FIG. 5D, in addition to the orientation data provided by the orientation-measuring device 316, data communicated to the data acquisition and logging panel, such as from the orientation-measuring device 316, can include device identifiers, addresses for each device, measure device voltage, shooting depth, status information, etc.

The various embodiments of the orientation-measuring device described in this disclosure can operate using particular stable communications protocols, has a higher level of control than mechanical devices, saves time before downhole operations, is radio-frequency (RF) and electrostatic discharge (ESD) safe, is made of rugged materials to survive downhole insertions and retrievals, and can include features such as detonator detection, detonator resistance measurement, downhole head voltage reading for each gun in the toolstring, and downhole temperature measurement. In some embodiments, data communicated from the orientation-measuring device can be in real-time, or communicated periodically or in bursts, such as setting an adjustable communication rate for the device to communicate data every few seconds, once a second, 100 times a second, etc. In some embodiments, data may only be set to be communicated pre-perforation, that is, after perforating guns are sent downhole.

The orientation data provided by the orientation-measuring device allows for operators on the surface to receive an accurate orientation of the gun prior to firing the gun, such as an accuracy of plus or minus 5 degrees or less. This allows for operators to check the gun orientation prior to firing and take remedial steps if the detected orientation is incorrect or undesirable, such as retrieving the wireline and reinserting, using a different gun, etc. In cases in which an orienting gun is used, if an incorrect orientation is detected, the system can also be programmed to wait for the orienting gun, which may be moving/rotating within the well, to reach an orientation within an accuracy threshold, and then detonation can be triggered upon reading an orientation measurement within tolerance as the orienting gun moves within the well. In this way, the switch can be set to initiate firing, or allow firing to be initiated, as soon as an orientation within tolerance is detected. Additionally, accelerometer readings (and/or possibly orientation readings in some cases) can be used to verify that a firing event has occurred. A firing event be confirmed using the accelerometer data received by identifying movement of the perforating guns due to the force of a firing event. As another example, in many cases the force of a firing event will cause the perforating gun to move to an extent, and thus, after firing is triggered, the orientation data communicated to the surface from the orientation-measuring device will typically be different than the orientation data communicated prior to the firing event. In some embodiments, data from the accelerometer(s) or other sensors in adjacent perforating guns can be used to verify firing of lower guns. For example, when a first gun fires, guns 2-8 upstream can record the event and offer verification in the event that the first gun's sensors were destroyed in the firing. In some existing approaches, cameras or special measurement devices are sent downhole to measure the actual orientations of each perforation after a perforation is performed. The orientation-measuring device of this disclose, however, transmits the orientation right at the moment of fire, which is much more time and cost efficient.

In various embodiments, operators may not review orientation data at all, but rather the firing process can be automated (although operators may still review data from time to time for process auditing purposes). For example, is a well needs to be perforated with an orientation of 0 degrees, the perforation switch can be programed to automatically perforate when the desired orientation has reached a certain accuracy without users needing to review the orientation data. In this case, when the orientation is within +/−10 degrees accurate, the system can be programmed to trigger the detonation.

Figure 6A:
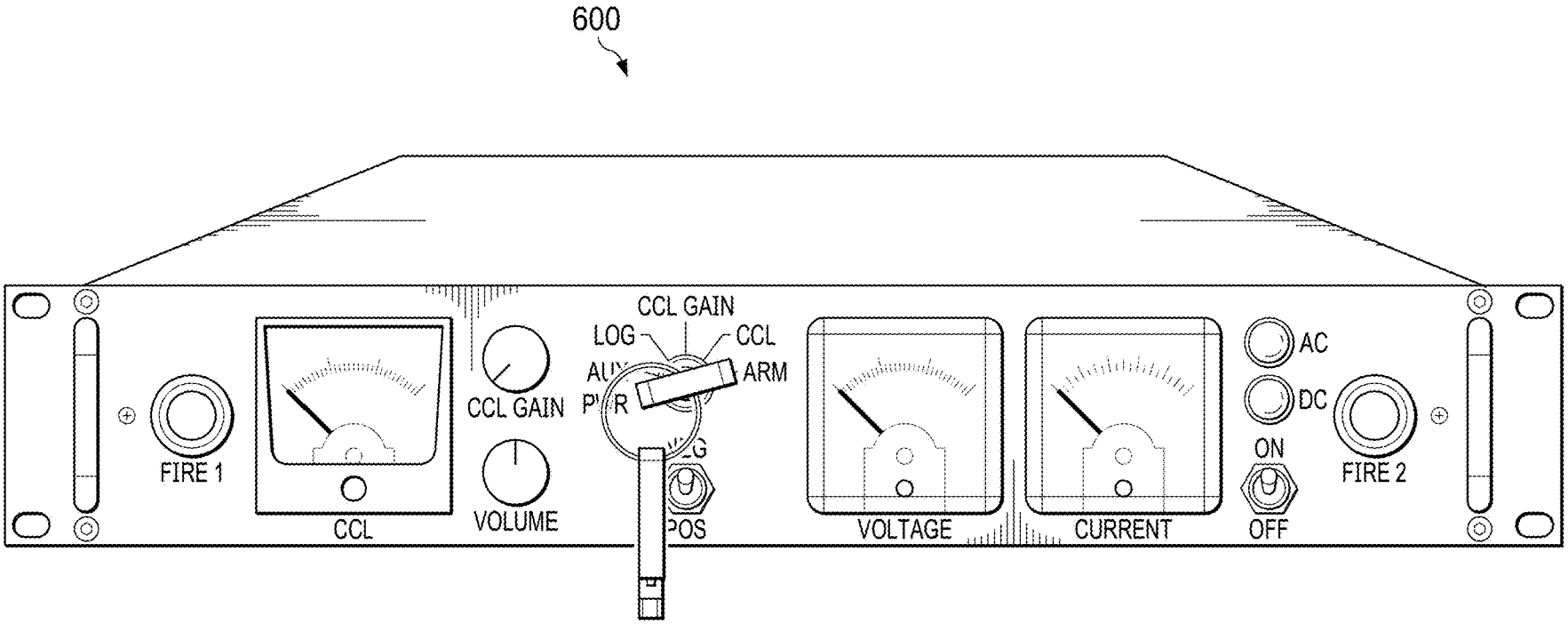
FIGS. 6A-6C illustrate an example shooting panel in accordance with this disclosure.
Figure 6B:
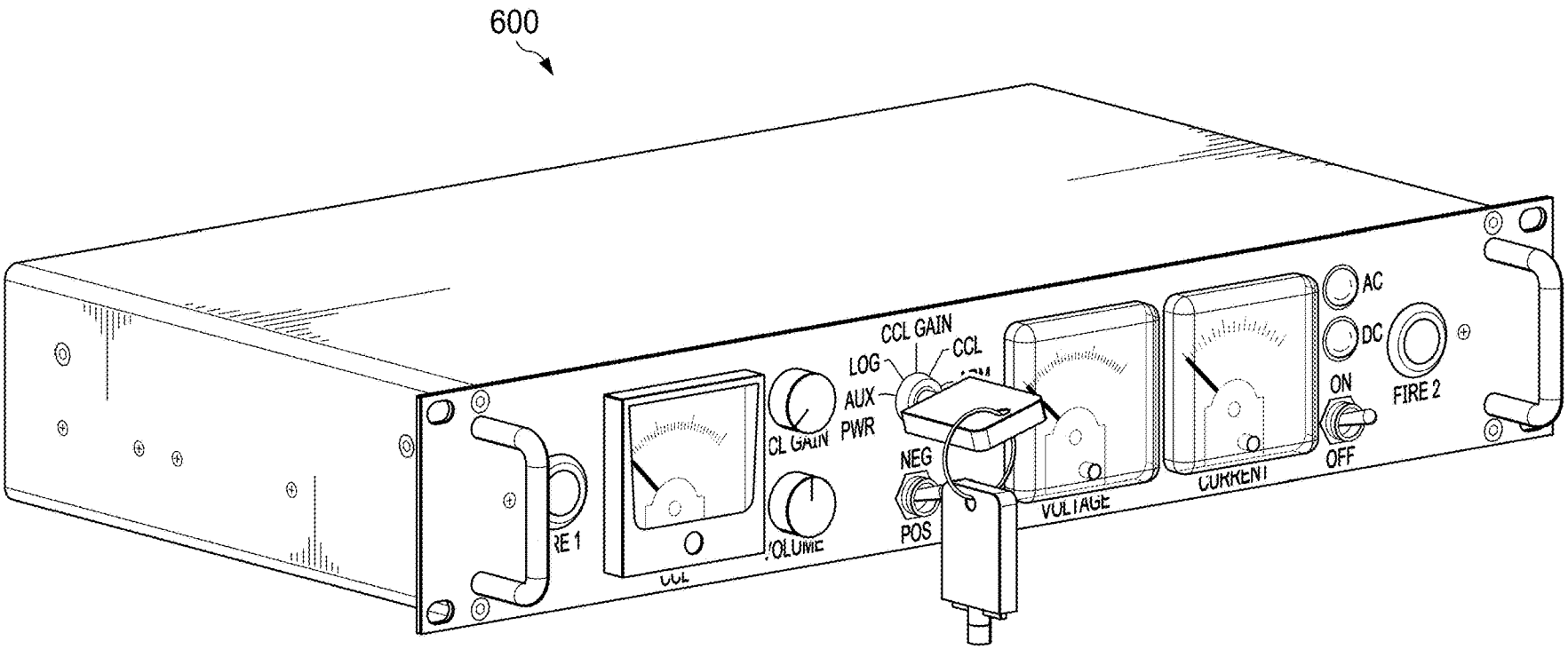
Figure 6C:
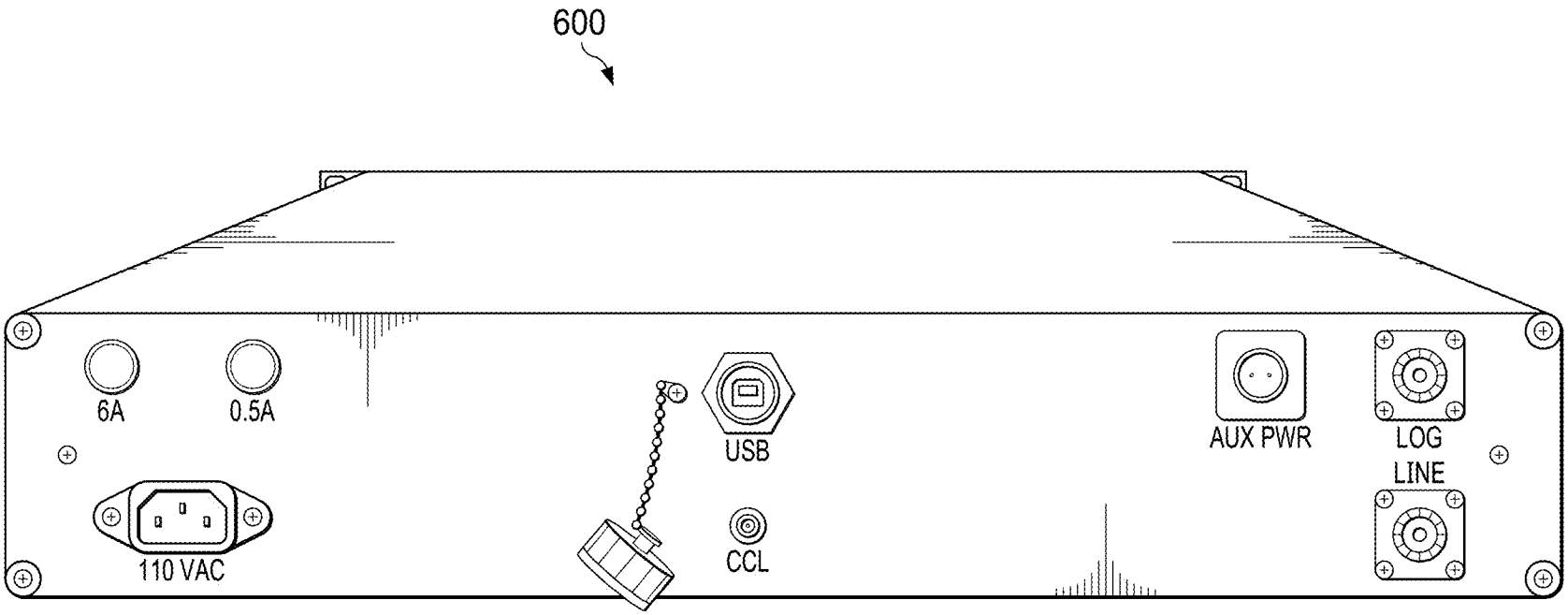

As also described above with respect to FIGS. 1 and 2, to perforate the rock or shale formation, an electrical current is sent down the wireline 305, such as instructed by a microcontroller or processor, to the orientation-measuring device 316 of the perforating gun 304. In embodiments in which the orientation-measuring device is a separate device from the perforation switch, the electrical current would be sent to the separate perforation switch instead. In some embodiments, the electrical current can be initiated by a programmable shooting panel. FIGS. 6A-6C illustrate an example shooting panel 600 in accordance with this disclosure. In various embodiments, the shooting panel can include features such as autonomous run eligibility, exact same waveform for each shoot, programmable and automatic shoot profiles, dual-fuse protection, positive and negative voltage support, integrated CCL, voltage and current meters, CCL gain and audible CCL volume control, support of up to 3A, 300V DC support, ramp-up voltage protection, a simple rack mounted design, CCL output for logging equipment, and multi-switch type compatibility. The surface shooting panel, with its high current capabilities and its log data pass-through, is versatile and can be used in situations that other shooting panels cannot be used.

The surface shooting panel can be optimized for 50 ohm detonators and can be also compatible with lower ohmage values. The surface shooting panel can also be compatible with multiple switch types due to being able to generate adjustable negative and positive voltage. The shooting panel can replace prior analog/manual control panels, provides power for plug, control, and release switches, and can relay logging data to logging equipment such as the data acquisition and logging panel. The shooting panel can include various connections and power controls, including a CCL connection to the logging system, port(s) s for connections to other devices (e.g., a USB port for connecting to a PC), a log connection for connection to the logging system, and a line connection point for connection to the wireline (e.g., wireline 305).

Upon transmission of the electrical current to the switch, one or more discharging units of the perforating gun 304 are activated and an explosive charge (e.g., Cyclotrimethylene Trinitramine (RDX), Hexanitrosilbene (HNS), Cyclotetramethylene Trinitramine (HMX), etc.) is discharged through apertures 306 to create holes (perforations 308) in the rock or shale formation, such as illustrated in FIG. 3B. The wireline can then be extracted from the hole and then fluid, sand, and/or chemicals are pushed downhole, which fills the perforations 308 at high pressure, to perform hydraulic fracturing, causing the rock or shale formation to fracture at the perforations 308. The horizontal section of the well can then be plugged with a temporary plug. The process can be repeated for multiple sections of the horizontal well, with each section being plugged until the entire horizontal section, or a desired portion thereof, is perforated and fracked.

Although FIGS. 3A and 3B illustrate one example of a horizontal perforation operation environment 300, various changes may be made to FIGS. 3A and 3B. For example, the operation illustrated could include any suitable number of each component in any suitable arrangement. As one example, there may be multiple perforating guns 304 inserted into the well, and each can have an orientation-measuring device installed therein. This allows for the orientation of each perforating gun 304 to be monitored, and for each perforating gun to be discharged based on detected orientation for each perforating gun being within a degree of accuracy. In general, perforating operations can be performed in a wide variety of ways, and FIGS. 3A and 3B do not limit the scope of this disclosure to any particular perforation methodology. Also, while FIGS. 3A and 3B illustrate one operational environment in which various features disclosed in this patent document can be used, these features could be used in any other suitable system or environment.

Figure 7A:
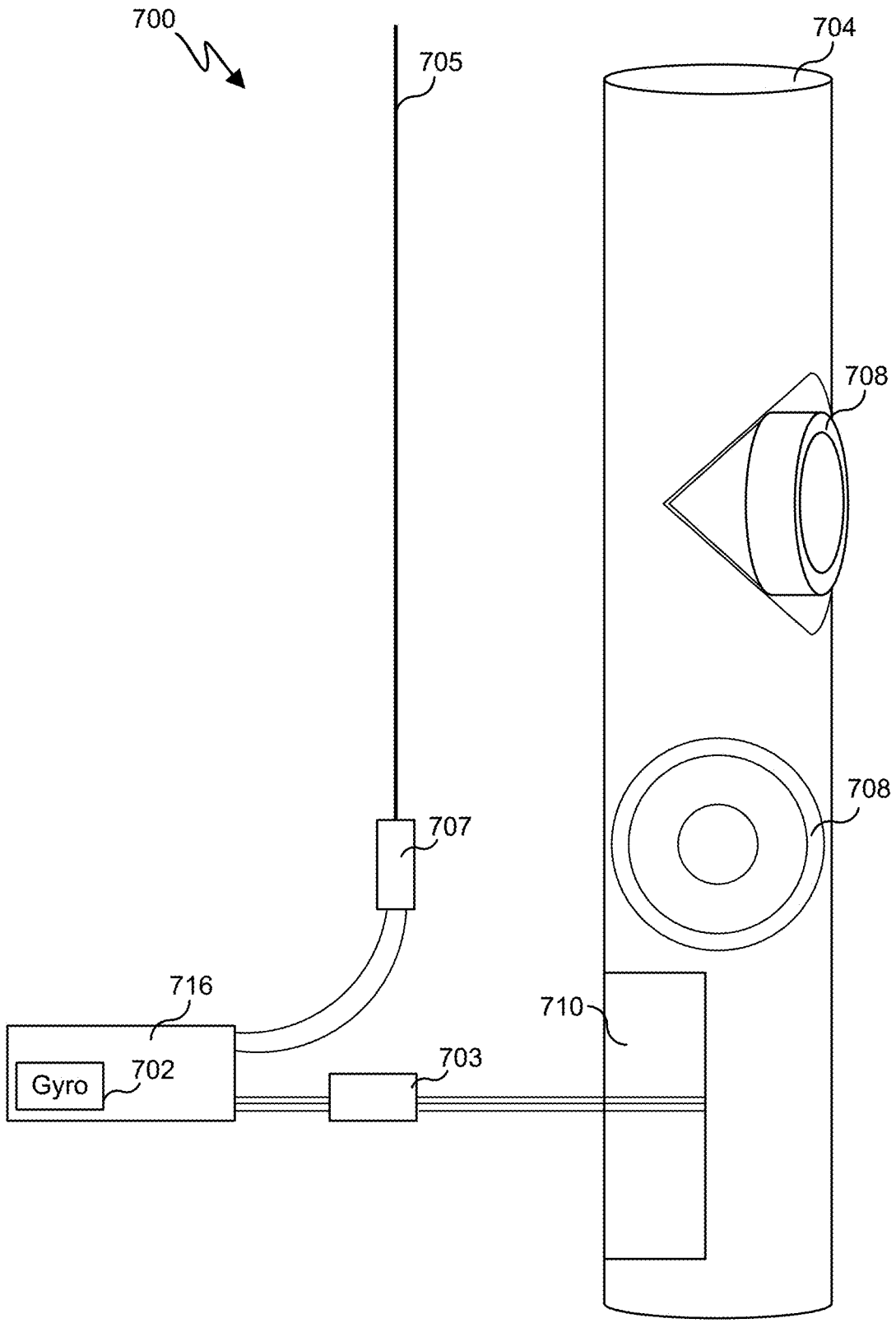
FIGS. 7A and 7B illustrate an example perforating gun assembly that includes an orientation-measuring device in accordance with this disclosure.
Figure 7B:
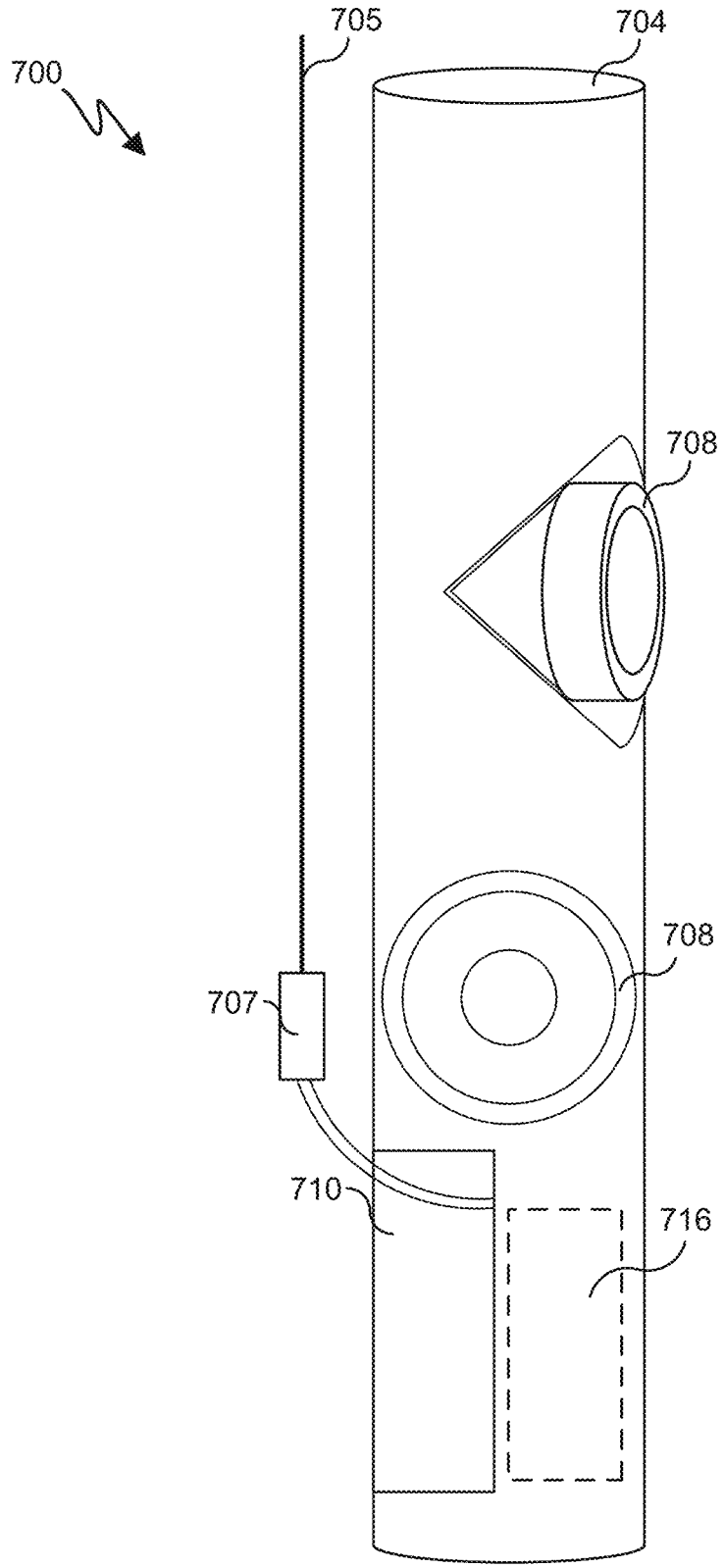

FIGS. 7A and 7B illustrate an example perforating gun assembly 700 that includes an orientation-measuring device 716 in accordance with this disclosure. The perforating gun assembly 700 can be used with the system 10, the operation environment 300, or in various other embodiments of this disclosure. The assembly 700 includes an orientation-measuring device 716 that includes a gyroscopic sensor 702, as well possibly other sensors as described in the various embodiments of this disclosure. The orientation-measuring device 716 is connected to a perforating gun 704. In some embodiments, one or more connecting wires of the orientation-measuring device 716 are connected to a pin body 703 to connect the orientation-measuring device to the perforating gun 704. The orientation-measuring device is connected to other devices such as other downhole or surface devices via a wireline 705. In some embodiments, one or more connecting wires of the orientation-measuring device 716 are connected to a pin body 707 to connect the orientation-measuring device to the wireline 705. The perforating gun 704 includes a plurality of discharge units 708 that are operable to discharge an explosive as controlled by the orientation-measuring device 716 and other devices connected to the wireline 705. In embodiments described herein in which the orientation-measuring device 716 is a separate device from the perforating or detonator switch, the orientation-measuring device 716 may only be connected up the toolstring and not necessarily communicatively connected to the perforating gun.

As shown in FIG. 7B, the orientation-measuring device 716 is installed within an interior 710 of the perforating gun 704. To ensure that proper orientation readings for the perforating gun 704 can be provided by the orientation-measuring device 716, the orientation-measuring device 716 is mounted to an interior surface of the perforating gun 704 so that the orientation-measuring device 716 moves and/or rotates in the same manner or degree as the orienting gun 704 so that detected orientation for the orientation-measuring device 716 can be correlated to an orientation of the perforating gun 704. The orientation-measuring device 716 can be mounted within the interior 710 of the perforating gun 704 in various ways, such as via glue or adhesive, screws, mounting brackets, pins, or other ways.

Although FIGS. 7A and 7B illustrate one example of a perforating gun assembly 700, various changes may be made to FIGS. 7A and 7B. For example, the perforating gun assembly 700 could include any suitable number of each component in any suitable arrangement. In general, perforating guns can come in a wide variety of configurations, and FIGS. 7A and 7B do not limit the scope of this disclosure to any particular configuration. Also, while FIGS. 7A and 7B illustrate one operational environment in which various features disclosed in this patent document can be used, these features could be used in any other suitable system.

Figure 8A:
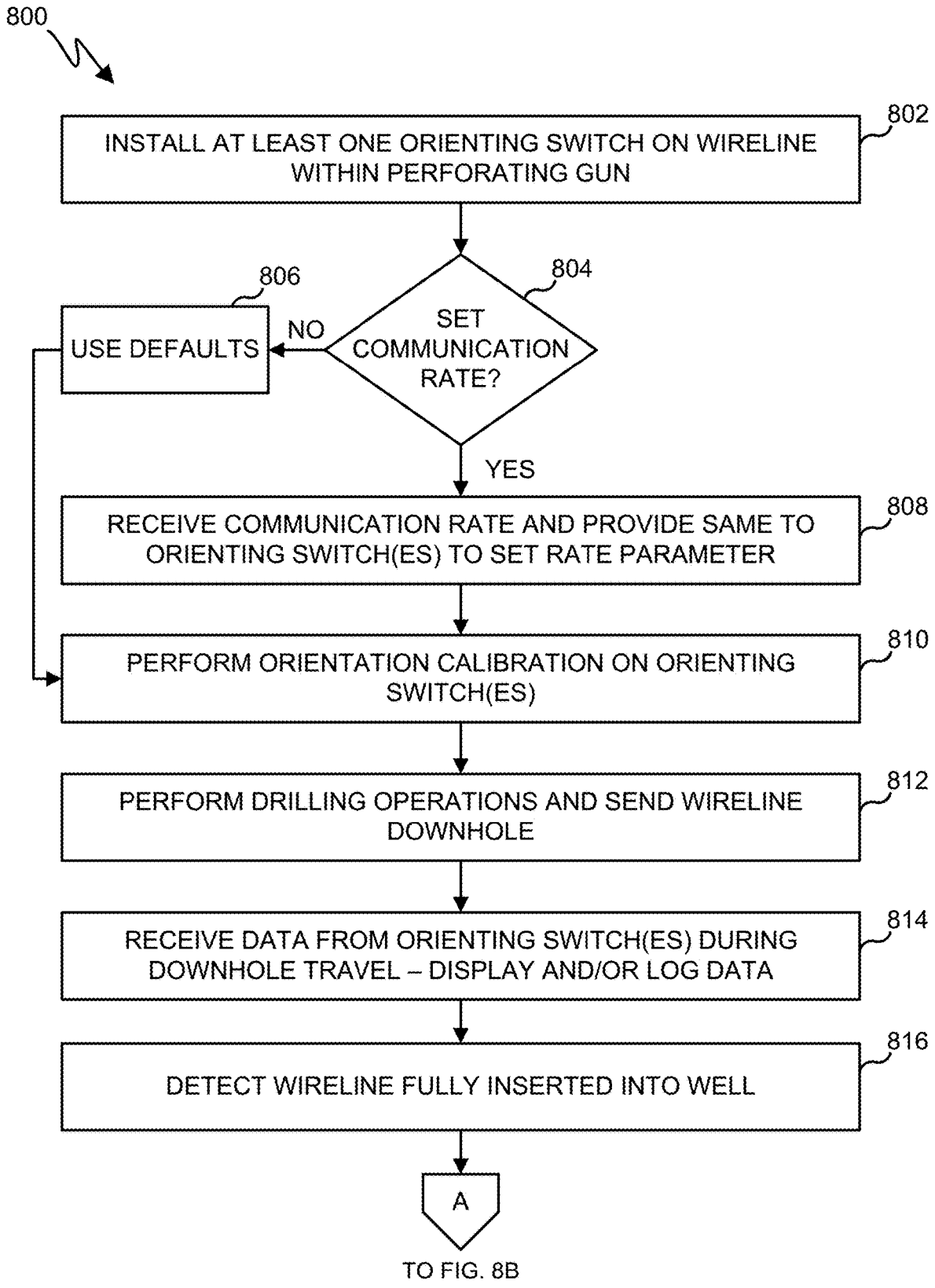
FIGS. 8A and 8B illustrate an example method for an orientation-measuring device in accordance with this disclosure.
Figure 8B:
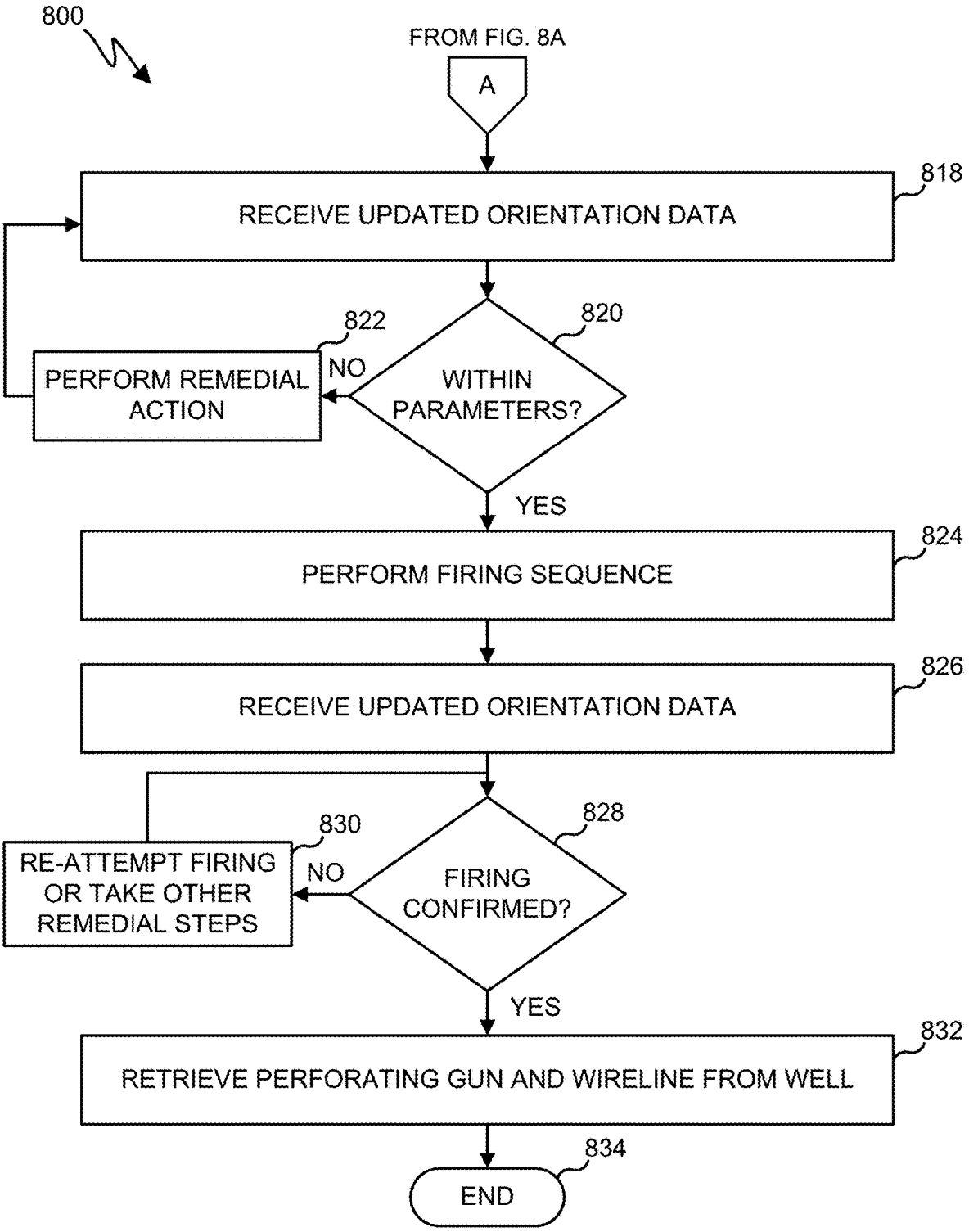

FIGS. 8A and 8B illustrate an example method 800 for an orientation-measuring device in accordance with this disclosure. For ease of explanation, the method 800 shown in FIGS. 8A and 8B is described as being performed using an orientation-measuring device in communication with a surface electronic device. However, the method 800 may be used with any other suitable device(s), and in any other suitable system(s).

At block 802, at least one orientation-measuring device is installed on a wireline and within a perforating gun. As described in this disclosure, one orientation-measuring device could be used for a perforating gun, or multiple orientation-measuring devices could be used to each monitor orientation for a plurality of perforating guns and/or to control firing of the perforating guns. As also described in this disclosure, the at least one orientation-measuring device is mounted to a surface within the gun(s), both to further protect the orientation-measuring device and to ensure orientation of the gun(s) can be properly detected.

At decision block 804, it is determined whether to set a communication rate for the orientation-measuring device(s). If so, at block 808, a communication rate is received and the rate is provided to the orientation-measuring device(s) to set the rate parameter at the orientation-measuring device(s). For example, this can include a processor of an electronic device that communicates with the orientation-measuring switches, such as the data acquisition and logging panel and/or the shooting panel, receiving a communication rate adjustment for the orientation-measuring switch(es), and then transmitting the communication rate to the orientation-measuring device(s) down the wireline, which in turn store the adjusted rate parameter. For instance, a communication rate of data communicated from the orientation-measuring switch can be in real-time, or communicated periodically or in bursts, such as setting an adjustable communication rate for the switch every few seconds, once a second, 100 times a second, etc. In some embodiments, different rates can be used for different switches. If, at decision block 804, a communication rate adjustment is not set, at block 806, the processor can use and set a default rate (e.g., real-time, 100 times a second, etc., depending on stored defaults). The method 800 then moves to block 810.

At block 810, an orientation calibration for the orientation-measuring device(s) is performed. The orientation calibration is performed to ensure that the orientation-measuring device(s) provide accurate orientation data once downhole. In various embodiments, this orientation calibration can include calculating an offset for each axis of the gyroscope. Each of the three axes should read as 0 degrees per second when the switch is not moving. The offsets can be measured by taking measurements while the orientation-measuring device(s) is not moving, and then those measure values can be used as offsets when reading the orientation values during operation. It will be understood that other calibration processes can be used.

At block 812, drilling operations are performed to create a well, and, afterwards, the wireline that includes the perforating gun and the orientation-measuring device(s) is sent downhole into the wellbore, as described in this disclosure. It will be understood that drilling operations to create the well can occur previously, e.g., prior to any of steps 802-810. At block 814, while the wireline travels through the drilled well, the orientation-measuring device(s) detect and relay orientation data, as well as any other data such as speed/acceleration of the wireline, real-time travel slope (e.g., 90 degrees, 45 degrees), downhole temperature, downhole head voltages for each gun in the toolstring, and/or detonator resistance, etc., as the orientation-measuring device(s) travels through the well. This can include a controller in the orientation-measuring device(s) receiving the sensor data, temporarily storing it in memory, and transmitting the sensor data pursuant to the communication rate set at block 804-808. The orientation-measuring device(s) can communicate these various readings up the wireline so that other devices such as surface electronic devices (such as the data acquisition and logging panel) can monitor, display, and/or log the data provided by the orientation-measuring switch.

At block 816, it is detected whether the wireline is fully inserted into the well, such as the wireline reaching an end of the drilled well or reaching a plug if previous fracking operations using a perforating gun with orientation-measuring switches has already occurred on a section of the well. In some embodiments, the orientation-measuring device(s) can assist with the detection at block 816, such as based on detecting that the orientation-measuring device(s) have stopped moving and/or is at the correct slope that corresponds to the slope of the end of the wellbore based on sensor data such as accelerometer data. At block 818, updated orientation data is received from the orientation-measuring device(s). This can include a processor or microcontroller in the orientation-measuring device(s) causing transmission of orientation data to another electronic device (such as the shooting panel and/or the data acquisition and logging panel), and the processor of the other electronic device uses the data to perform steps of the method 800 using the orientation data. As described in this disclosure, orientation data may only be communicated at block 818 once the perforating gun(s) are sent downhole, to provide a snapshot of orientation data right before perforation is attempted.

For example, at decision block 820, it is determined whether the orientation data received is within parameters, such as whether the orientation detected corresponds to an expected orientation for the perforating gun—that is, whether the perforating gun is oriented in to create perforations in a desired direction. This can include the processor of the other electronic device using the orientation data to make this determination. If, at decision block 820, it is determined that the orientation is not within parameters, at block 822, remedial action can be taken, such as such as retrieving the wireline and reinserting it, using a different gun, etc. However, in other embodiments as described elsewhere in this disclosure, such as if a self-orienting gun is used, the method 800 can simply loop at decision block 820 until an orientation within tolerance is detected. If, at decision block 820, it is determined that the orientation of the perforating gun is within parameters, at block 824, a firing sequence is performed trigger one or more of the discharge units of the perforating gun, such as described elsewhere in this disclosure. As described in this disclosure, this firing sequence can be automated, such as triggering an automatic firing of the perforating gun(s) upon detection of orientation being with +/−10 degrees (or other set thresholds).

At block 826, updated orientation data is received from the orientation-measuring device(s). At decision block 828, using the updated orientation data received at block 826, it is determined whether a firing of the perforating gun(s) is confirmed. For example, this can include the processor of the other electronic device showing that, after the firing sequence performed at block 824, the orientation of the orientation-measuring device(s) and perforating gun has shifted to a degree, indicating that the explosive impact of the firing sequence caused the perforating gun to move within the wellbore. This movement of the gun(s) can also be detected using accelerometer data received from the orientation-measuring device(s). This allows the orientation-measuring device(s) to be used as extra confirmation of a successful shooting operation. If, at decision block 828, it is determined the firing is not confirmed, the method 800 in some embodiments can move to block 830 at which a firing is re-attempted or other remedial actions such as using a different perforating gun can be performed. If, at decision block 828, the firing is confirmed to be successful, at block 822 the perforating gun and wireline are retrieved from the well. From there, other operations can be performed such as performing hydraulic fracturing on the section of well that was perforated, plugging the fracked section of the well, and possibly performing steps of the method 800 again to perforate another section of the well. The method 800 ends at block 834.

Although FIGS. 8A and 8B illustrate one example of a method 800 for an orientation-measuring switch, various changes may be made to FIGS. 8A and 8B. For example, while shown as a series of steps, various steps in FIGS. 8A and 8B could overlap, occur in parallel, occur in a different order, or occur any number of times.

Figure 9:
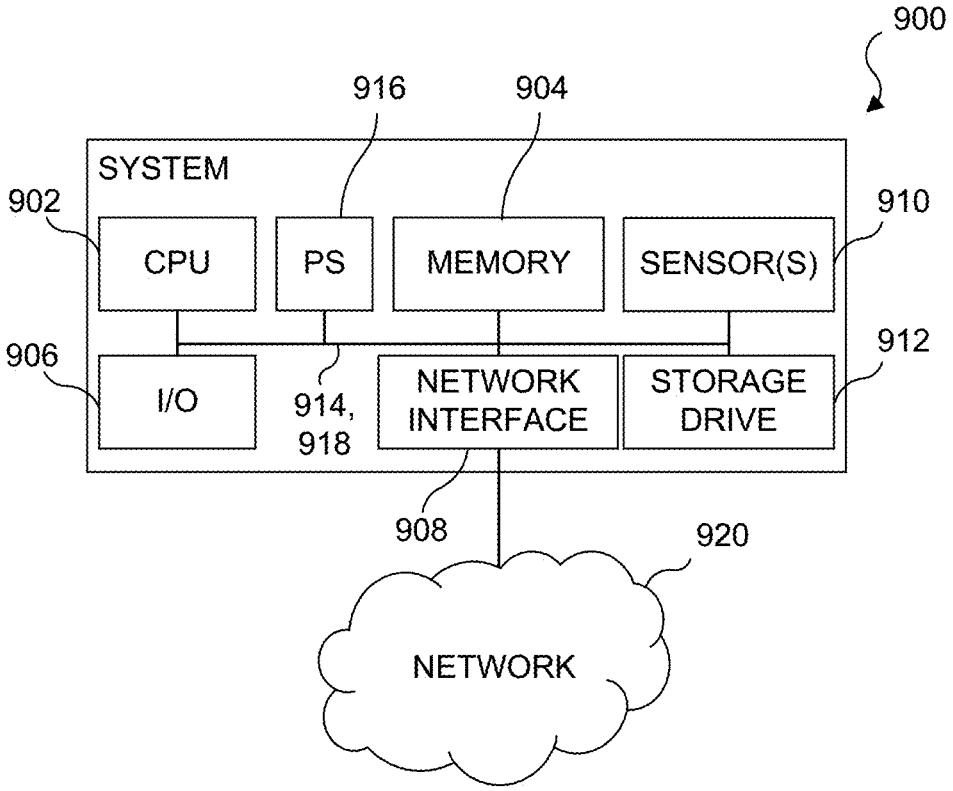
FIG. 9 illustrates an example electronic device in accordance with this disclosure.

FIG. 9 illustrates an example electronic device 900 in accordance with this disclosure. The device 900 can be one example of an electronic device or a portion thereof, such as surface electronic devices like the data acquisition and logging panel or the shooting panel described in this disclosure. The system 900 can include a controller (e.g., a processor/central processing unit ("CPU")) 902, a memory unit 904, and an input/output ("I/O") device 906. The device 900 also includes at least one network interface 908, or network interface controllers (NICs). The device 900 further includes at least one sensor 910 for capturing media or inputs to the system through an I/O device, such as voltage measurement sensors, temperature sensors, gyroscopic sensors, acceleration sensors, etc. The at least one sensor can also be another electronic device external to the electronic device 900, such as an orientation-measuring switch like that described in this disclosure. The device 900 also includes a storage drive 912 used for storing information such as received sensor data. The components 902, 904, 906, 908, 910, and 912 are interconnected by a data transport system (e.g., a bus) 914. A power supply unit (PSU) 916 provides power to components of the system 900 via a power transport system 918 (shown with data transport system 914, although the power and data transport systems may be separate).

It is understood that the system 900 may be differently configured and that each of the listed components may actually represent several different components. For example, the CPU 902 may actually represent a multi-processor or a distributed processing system; the memory unit 904 may include different levels of cache memory, and main memory; the I/O device 906 may include monitors, keyboards, display screens or touchscreens, and the like; the at least one network interface 908 may include one or more network cards providing one or more wired and/or wireless connections to a network 920; and the storage drive 912 may include hard disks and remote storage locations. Therefore, a wide range of flexibility is anticipated in the configuration of the system 900, which may range from a single physical platform configured primarily for a single user or autonomous operation to a distributed multi-user platform such as a cloud computing system.

The system 900 may use any operating system (or multiple operating systems), including various versions of operating systems provided by Microsoft (such as WINDOWS), Apple (such as Mac OS X), UNIX, RTOS, and LINUX, and may include operating systems specifically developed for handheld devices (e.g., iOS, Android, RTOS, Blackberry, and/or Windows Phone), personal computers, servers, and other computing platforms depending on the use of the system 900. In some embodiments, the system 900 can be a compact system such as a Raspberry Pi running a Linux-based operating system such as Debian. The operating system, as well as other instructions (e.g., for telecommunications and/or other functions provided by the device 900), may be stored in the memory unit 904 and executed by the processor 902. For example, the memory unit 904 may include instructions for performing some or all of the steps, process, and methods described herein.

The network 920 may be a single network or may represent multiple networks, including networks of different types, whether wireless or wired. For example, the device 900 may be coupled to external devices via a network that includes a cellular link coupled to a data packet network or may be coupled via a data packet link, such as a wide local area network (WLAN) coupled to a data packet network or a Public Switched Telephone Network (PSTN). Accordingly, many different network types and configurations may be used to couple the device 900 with external devices. In some embodiments, the electronic device can transmit information over the network 920 to other devices. For example, if the electronic device is the data acquisition and logging panel described in this disclosure, the data received from downhole components such as the orientation-measuring switch and display of such data could be streamed to other remote electronic devices over the network 920 to allow for remote monitoring of perforation or fracking operations.

Components in the electronic device 900 may also be included in an orientation-measuring switch described in this disclosure. For example, the orientation-measuring switch can include a power supply, sensors such as gyroscopic and/or acceleration sensors, a memory for temporarily or permanently storing settings and sensor data, an interface for communicating sensor data to one or more other electronic devices that are either downhole or on the surface, and a processor, microcontroller, or chip for controlling the components of the orientation-measuring switch.

Although this disclosure has been described with example embodiments, various changes and modifications may be suggested to one skilled in the art. It is intended that this disclosure encompass such changes and modifications as fall within the scope of the appended claims.

What is claimed is:

1. An apparatus for measuring orientation of a downhole perforating gun system, the apparatus comprising:

a housing or platform for attachment to an interior of a perforating gun, a loading tube, or shape charges for a perforation wireline;

at least one sensor configured to measure orientation information of the perforating gun, the loading tube, or the shape charges, wherein the at least one sensor includes one or more of a gyroscope, accelerometer, or magnetometer;

at least one controller that controls the at least one sensor; and a communications interface for communicating the measured orientation information to one or more electronic devices communicatively coupled to the apparatus, wherein the at least one controller is configured to:

cause transmission, using the communications interface, of the measured orientation information, which corresponds to an orientation of at least one of the perforating gun, the loading tube, or the shape charges, to the one or more electronic devices;

initiate a firing sequence of the perforating gun or the shape charges based on a signal received from at least one of the one or more electronic devices;

receive a transmission indicating whether or not the firing sequence of the perforating gun or the shape charges is confirmed based on an indication, using the at least one sensor, of whether or not the perforating gun or the shape charges has moved due to a force of a firing event by comparing orientation data received from the at least one sensor prior to the firing sequence with orientation data received from the at least one sensor after the firing sequence;

initiate a re-firing sequence of the perforating gun or the shape charges in response to receiving the transmission indicating that the firing sequence of the perforating gun or the shape charges is not confirmed; and receive a transmission indicating the re-firing sequence is confirmed using the at least one sensor, wherein, in response to an event in which a sensor of the at least one sensor is destroyed during the re-firing sequence, the transmission indicating the re-firing sequence is confirmed is received from a sensor associated with another perforating gun, loading tube, or shape charges, of the downhole perforating gun system, upstream of the destroyed sensor.

2. The apparatus of claim 1, wherein the apparatus is at least a part of a perforation switch that initiates a perforation of the perforating gun.

3. The apparatus of claim 1, wherein the apparatus is at least part of an electronic detonator disposed inside of the perforating gun.

4. The apparatus of claim 1, wherein the at least one controller is further configured to cause transmission, to the one or more electronic devices or another downhole controller, of data corresponding to the measured orientation information of the shape charges.

5. The apparatus of claim 1, wherein the at least one controller is further configured to receive data from the one or more electronic devices corresponding to an orientation range allowed to perforate the shape charges.

6. The apparatus of claim 1, wherein the measured orientation information is measured in three degrees of freedom, 6 degrees of freedom, or 9 degrees of freedom.

7. The apparatus of claim 1, wherein the at least one sensor is configured to measure the orientation information in real-time or based on an adjustable transmission rate.

8. The apparatus of claim 1, wherein the at least one controller is further configured to receive an acceptable orientation range to initiate perforation.

9. The apparatus of claim 8, wherein the acceptable orientation range to initiate perforation is +/−20 degrees from a center alignment.

10. The apparatus of claim 1, wherein, the initiating of the re-firing sequence of the perforating gun or the shape charges includes switching to using a different perforating gun or different shape charges.

11. A method comprising:

sending a downhole perforating gun system into a portion of a wellbore, the downhole perforating gun system including an apparatus having a housing or platform for attachment to an interior of a perforating gun, a loading tube, or shape charges for a perforation wireline;

measuring, using at least one sensor of the apparatus, orientation information of the perforating gun, the loading tube, or the shape charges, wherein the at least one sensor includes one or more of a gyroscope, accelerometer, or magnetometer;

transmitting, by a controller of the apparatus that controls the at least one sensor and using a communications interface of the apparatus, the orientation information, which corresponds to an orientation of at least one of the perforating gun, the loading tube, or the shape charges, to one or more electronic devices communicatively coupled to the apparatus;

initiating a firing sequence of the perforating gun or shape charges based on a signal received from at least one of the one or more electronic devices;

receiving a transmission indicating whether or not the firing sequence of the perforating gun or the shape charges is confirmed based on an indication, using the at least one sensor, of whether or not the perforating gun or the shape charges has moved due to a force of a firing event by comparing orientation data received from the at least one sensor prior to the firing sequence with orientation data received from the at least one sensor after the firing sequence;

initiating a re-firing sequence of the perforating gun or the shape charges in response to receiving the transmission indicating that the firing sequence of the perforating gun or the shape charges is not confirmed; and receiving a transmission indicating the re-firing sequence is confirmed using the at least one sensor, wherein, in response to an event in which a sensor of the at least one sensor is destroyed during the re-firing sequence, the transmission indicating the re-firing sequence is confirmed is received from a sensor associated with another perforating gun, loading tube, or shape charges, of the downhole perforating gun system, upstream of the destroyed sensor.

12. The method of claim 11, wherein the apparatus is at least a part of a perforation switch that initiates a perforation of the perforating gun.

13. The method of claim 11, wherein the apparatus is at least part of an electronic detonator disposed inside of the perforating gun.

14. The method of claim 11, further comprising transmitting, to the one or more electronic devices or another downhole controller, data corresponding to the measured orientation information of the shape charges.

15. The method of claim 11, further comprising receiving data from the one or more electronic devices corresponding to an orientation range allowed to perforate the shape charges.

16. The method of claim 11, wherein the measured orientation information is measured in three degrees of freedom, 6 degrees of freedom, or 9 degrees of freedom.

17. The method of claim 11, further comprising measuring, using the at least one sensor, the orientation information in real-time or based on an adjustable transmission rate.

18. The method of claim 11, further comprising receiving an acceptable orientation range to initiate perforation.

19. The method of claim 18, wherein the acceptable orientation range to initiate perforation is +/−20 degrees from a center alignment.

20. The method of claim 11, wherein, the initiating of the re-firing sequence of the perforating gun or the shape charges includes switching to using a different perforating gun or different shape charges.

* * * * *